United States Patent [19]

Harper

[11] Patent Number: 4,672,300

[45] Date of Patent: Jun. 9, 1987

[54] DIRECT CURRENT POWER SUPPLY USING CURRENT AMPLITUDE MODULATION

[75] Inventor: Raymond G. Harper, San Ramon, Calif.

[73] Assignee: Braydon Corporation, San Ramon, Calif.

[21] Appl. No.: 717,857

[22] Filed: Mar. 29, 1985

[51] Int. Cl.[4] ..... G05F 1/46

[52] U.S. Cl. ..... 323/222; 323/285; 363/97

[58] Field of Search ..... 323/222, 224, 266, 275, 323/284, 285, 299, 303, 319, 320, 235, 237; 315/DIG. 5, DIG. 7, 243, 244, 245; 361/103, 105; 363/37, 89, 90, 95, 97, 131

[56] References Cited

U.S. PATENT DOCUMENTS

| | | | |
|---|---|---|---|
| 3,974,439 | 8/1976 | Holland | 323/222 |
| 4,068,277 | 1/1978 | Simokat | 361/105 |
| 4,253,055 | 2/1981 | Gatten | 323/285 |
| 4,258,308 | 3/1981 | Weischedel | 323/285 |
| 4,368,420 | 1/1983 | Kuo | 323/303 |
| 4,392,103 | 7/1983 | O'Sullivan et al. | 325/285 |
| 4,428,015 | 1/1984 | Nesler | 323/285 |
| 4,471,418 | 9/1984 | Tuma | 323/299 |
| 4,524,305 | 6/1985 | Martin | 315/DIG. 7 |

FOREIGN PATENT DOCUMENTS

| | | | |
|---|---|---|---|
| 91517 | 5/1984 | Japan | 323/222 |
| 2091915 | 8/1982 | United Kingdom | 323/222 |

*Primary Examiner*—Peter S. Wong
*Assistant Examiner*—Judson H. Jones
*Attorney, Agent, or Firm*—Cushman, Darby & Cushman

[57] ABSTRACT

A switched-mode power supply for producing a DC voltage output from a unidirectional-current or alternating-current input uses amplitude modulation of current through and inductor. Input terminals joined to the inductor receive the input. A switch in series connection with the inductor responds to a switching signal for controlling the inductor current. A capacitor and diode store energy received from the inductor. A computation circuit is joined to a switch control circuit for sensing the inductor current and producing a switching signal for opening the switch when the inductor current reaches a desired maximum. A reference voltage generator, which produces a signal indicative of the maximum inductor current, includes an adjustment circuit for modulating an error signal, derived from an integral of the difference between a desired output voltage and the actual output voltage, by the input voltage. Inductor current is thereby modulated in phase with input voltage. A quick response circuit is provided for controlling rapid fluctuations in the output voltage. An alternating current source is provided which includes a resonant oscillator for producing an alternating current having a substantially pure sine wave output. A thermally-activated safety switch is also provided for absorbing energy when high voltage surges appear on the input terminals of the power supply.

37 Claims, 10 Drawing Figures

DIRECT CURRENT POWER SUPPLY USING CURRENT AMPLITUDE MODULATION

BACKGROUND OF THE INVENTION

This invention pertains to DC power supplies, and particularly, to such power supplies for converting an input AC voltage to a DC voltage. The present invention is particularly adapted for providing a DC power supply usable in electronic ballasts for fluorescent lighting systems.

The following discussion and description of the invention is directed specifically to such a ballast. However, it is not limited to this use. In fact, it is also applicable to any circuit requiring a power supply having the characteristics provided by this invention.

Electronic ballasts replace earlier core ballasts, achieving greater power efficiency and operability over a wider range of conditions. The advantages of the electronic ballasts are set forth in "Electronic Ballast Improves Efficiency," by R. R. Verderber, *Electrical Consultant*, November/December 1980, pages 22–26. Examples of prior art electronic ballasts are taught in Stevens, U.S. Pat. No. 4,277,728.

Such previous practice has been to use a standard pulse width modulated (PWM) regulator to control a buck-boost circuit or a buck circuit for generating a DC output voltage from an AC line voltage. These circuits used an input capacitor which was kept small to avoid low power factor and input current waveform distortion. Its actual value depended on the peak power to be handled, the input voltage, and the switching frequency.

Because this input capacitor has to be small, it does not store sufficient energy to prevent the waveform of the rectified line voltage from being effectively a rectified sine wave. This means that a pulse width modulated buck converter cannot draw power until the line voltage reaches the output voltage. This gives dead periods around the zero intercepts of the line voltage during which no line current flows. Such circuits also have to be optimized for operation at a specific line voltage level. They are thus less than optimized at other levels. The converters circuits must also handle higher line voltage peak levels since they are not controlled by the input capacitor. However, in power supplies where input power factor and current distortion are not considered important, a very large input capacitor gives an almost smooth voltage.

It can be seen in such an arrangement that a circuit having a limited sized capacitor is much more prone to damage by rapid line surges, and the like. Radio frequency interference (RFI) is not well filtered. It is also difficult to design a soft start circuit having such an input stage. Further, the energy storage required to prevent excessive ripple of the output voltage must be achieved with other circuit components.

If a PWM regulator has too much gain at the frequency of the ripple voltage on the input capacitor, the output storage capacitor will effectively be connected to the input capacitor, since the duty cycle adjusts rapidly. This causes more conductance when the line voltage is low and less when it is high. The resulting capacitive current flow produces line current distortion and a poor power factor. This is often prevented by setting the DC gain of the PWM system high enough to maintain sufficient load and line regulation, but the AC gain is reduced to zero at input line frequency.

This reduction in AC gain has detrimental side effects. The output voltage is no longer stable against medium frequency fluctuations of the line voltage or the load. Also, if the inductor current does not fall to zero before each switch closure, the line current will not be proportional to the line voltage at each instant of the line cycle.

This latter point can be seen by considering the operation when the inductor current always does fall to zero. In such a case, the PWM operation is at a constant frequency, and over any one line cycle, the duty cycle is constant (due to the low AC gain). While the switch is closed, the voltage across the inductor is a function of the instantaneous line voltage. This translates into a rising inductor current, with the rate of rise dependent upon the line voltage. Since the period that the switch is closed is constant, the amplitude reached is in turn proportional to the line voltage.

When the switch opens, the output voltage appears across the inductor as a back electromotive force. Since the output voltage is nominally stabilized at some constant level, the rate of fall of inductor current is constant. It follows that since the amplitude reached is proportional to the line voltage, and the rate of fall is fixed, the time to reach zero from when the switch opens is proportional to the line voltage.

If each charge of energy put into the inductor is allowed to transfer out to the load before the switch recloses, the next charge will be proportional to the line voltage. However, if charge is still in the inductor when the switch closes, then the new charge drawn from the line will not be in the same proportion to the line voltage. The inductor current and the instantaneous line current will rise to higher levels. This has the effect of causing third harmonic current distortion. Also, if the inductor is larger than a critical value, both the power factor and line current waveforms suffer. Any closure of the switch while inductor current is flowing causes diode losses due to storage delay in the associated current-direction-limiting diode.

If the inductor is smaller than the critical value, the circuit will be less efficient because the periods when no inductor current is flowing have to reflect as higher peak inductor current amplitudes to keep the same power level. This increases the inductor current form factor (RMS/mean) and $I^2R$ losses. It also puts extra peak current handling requirements onto components, such as the switch, diodes, magnetics, and capacitors.

Even if the designer could ensure that the inductor was exactly the critical value for any given load and instantaneous line voltage, it would be the wrong value for all other conditions. The system has a minimum input voltage variation of zero to approximately $1.414 \times$ RMS line voltage. When load, component tolerance, and drift variations are also considered, the peak currents experienced are perhaps twice what would occur if the inductor current only just reached zero when the switch recloses.

It is therefore a general object of the present invention to provide a power supply overcoming the just-described shortcomings of the prior art.

In particular, it is an object to provide a DC power supply using current amplitude modulation. Other objects of the present invention are to provide such a power supply which:

a. has increased electrical efficiency due to the elimination of dead periods when no inductor current flows;

b. is optimized for maximum efficiency at all expected levels of input voltage and load;

c. maintains operating efficiency by compensating for major component value changes;

d. resists damage from line transients and rapid surges;

e. overcomes the need for soft start circuits as required for conventional PWM circuits;

f. minimizes ripple in the output voltage while maintaining input power factor;

g. only just lets the inductor current reach zero during each period when the switch is open;

h. does not rely on a fixed time and line voltage relationship to ensure that the line current is proportional to the line voltage;

i. resists damage from high levels of input line voltage;

j. generates a substantially pure sine wave output;

k. provides a thermally-activated safety switch to absorb energy when high voltage surges appear on the input power line and temporarily disconnect the ballast from the power supply;

l. provides a quick response circuit for controlling rapid fluctuations in the output voltage;

m. provides controlled current flow to lamps which are powered by the supply;

n. provides an alternating current output circuit having a computation circuit which compares signals representative of the voltage and current output; and o. provides a control circuit for controlling the intensity of lamps powered by the supply.

SUMMARY OF THE INVENTION

The present invention provides a power supply for producing a direct current output voltage. The supply converts an alternating or direct current line voltage into a rectified voltage. This latter voltage is applied to an inductor, in series with a switch, which stores energy while the switch is closed. When the switch is open, the stored energy is fed through a diode to an energy-storing capacitor, to produce an output DC voltage across its terminals. The input and output voltage levels and inductor current are monitored. A computed varying reference maximum inductor current is derived from the integral of an error signal based on variance of the output voltage from a desired output voltage multiplied by a signal derived from the input rectified voltage. A switching signal is produced which is transmitted to a switch controller. The switch is opened when the instantaneous computed reference maximum inductor current is reached and is closed when zero inductor current is reached.

An alternating current source for powering a load is operably connected to the direct current output and includes a switched resonant oscillator for producing an alternating current and a second switch driver for controlling the oscillator. An output voltage monitor and arc current monitor generates signals representative of the output voltage and arc current, respectively. A computation circuit compares the signals so produced and generates a second switch driver control signal in response thereto.

A lamp heater output circuit is provided for controlling current flow to a load. A controller for dimming the ballast circuit is provided. The controller signal is suitable for transmission over non-power lines, such as telephone lines.

A thermally-activated safety switch is provided, which includes, in the preferred embodiment, a pair of metal oxide varistors thermally mounted adjacent a thermal switch. The safety switch absorbs energy when high voltage surges appear on the input power lines and temporarily disconnects the ballast from the line power supply.

It will be seen that this invention satisfies the objects stated. These and additional objects and advantages of the present invention will be more clearly understood from a consideration of the drawings and the following detailed description of a preferred embodiment.

DETAILED DESCRIPTION OF THE INVENTION

Description of General Circuit Structure

Figures 1, 2:
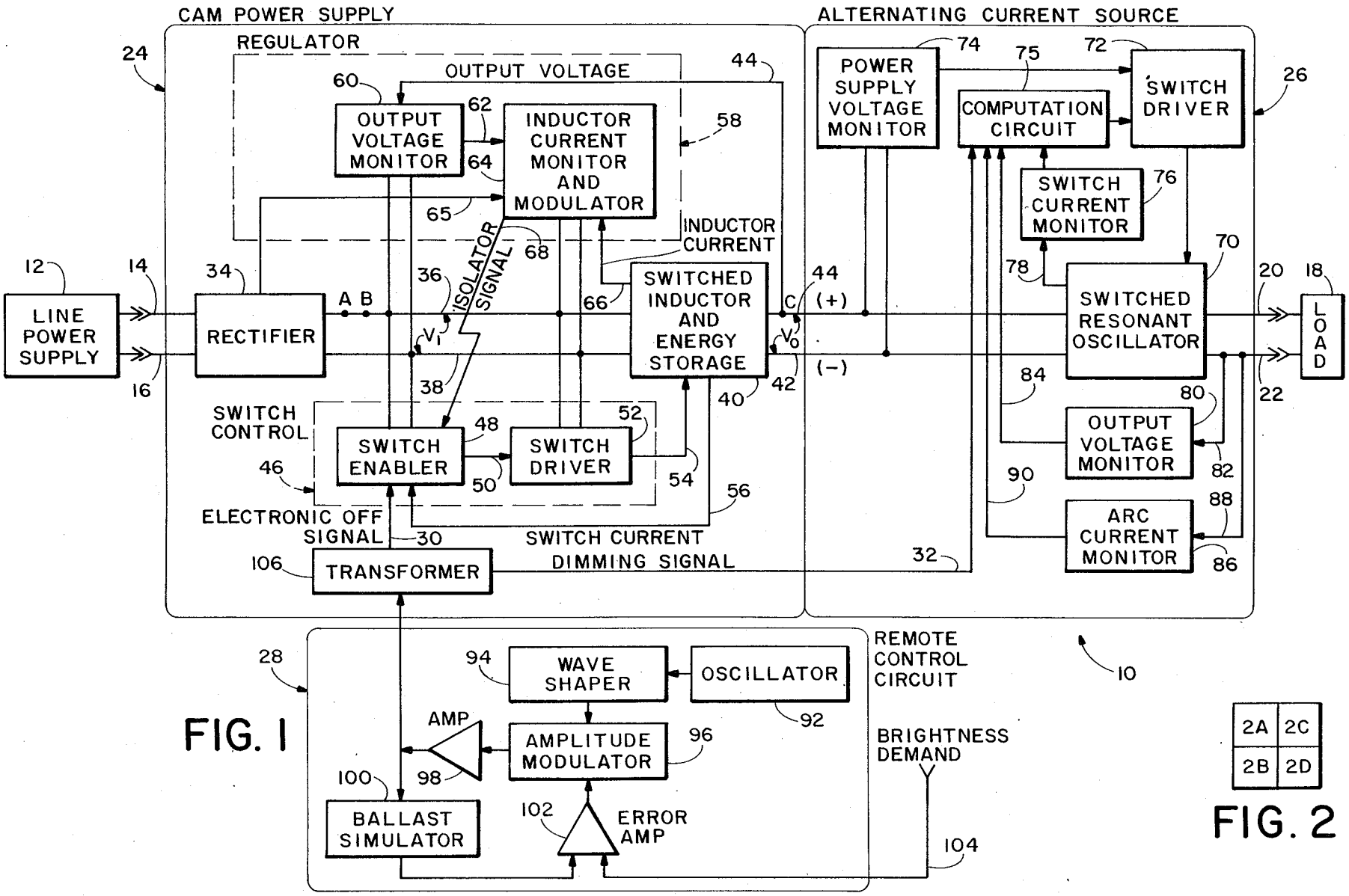
FIG. 1 is a block diagram of an electronic ballast circuit, including a power supply, alternating current source and remote control circuit, made in accordance with the present invention.
FIG. 2 is a diagram showing the relationship of FIGS. 2A–2D which are schematic diagrams of the power supply and current source of the circuit of FIG. 1.

Referring initially to FIG. 1, an electronic ballast or apparatus for converting a unidirectional input voltage, shown generally at 10, is joined to an external line power supply 12 through a pair of input line terminals 14, 16. It is also joined to a load 18 through a pair of alternating-current or auxilliary output terminals 20, 22.

Ballast 10 includes a current amplitude modulated power supply 24 made according to the present invention and joined to input terminals 14, 16. The ballast also includes an alternating current source 26 joined to supply 24 and output terminals 20, 22. A remote control circuit 28, also referred to as external signal creating means, is joined to supply 24 for providing what is referred to as an Electronic Off (EO) signal on conductor 30. As will be seen in the following discussion, signal 30 is used to turn supply 24 off while it is still connected to line power supply 12. Circuit 28 also produces a dimming signal on conductor 32 which is connected to source 26.

Describing now each portion of ballast 10 more specifically, current amplitude modulated power supply 24 includes a rectifier, or rectifier means 34, which is connected to input terminals 14, 16. The rectifier produces on a pair of output conductors 36, 38, a unidirectional-current voltage. This voltage is shown as $V_I$ in FIG. 1. Conductors 36, 38 are also referred to unidirectional-current input terminals. Conductor 36 also has a pair of nodes identified as node A and node B. The connection of these nodes provides operation of the circuit in a buck-boost configuration. An alternate connection configuration to provide a buck circuit, which requires breaking contact between nodes A, B, will also be described.

Rectifier 34, through conductors 36, 38 is joined to what is referred to as a switched inductor and energy storage circuit 40. This circuit produces at a pair of direct-current output terminals 42, 44 a direct-current output voltage shown as $V_O$. Circuit 40 includes a switch which is operated by a switch control circuit, shown generally at 46, also referred to as switch control means. Circuit 46 includes a switch enabler (switch enabling means) 48, connected to conductors 36, 38. Enabler 48 transmits an enabling signal and a switching signal over a conductor 50 to a switch driver (switch driver means) 52 which controls the switch contained within circuit 40. This switch is controlled by transmission of the switching signal over a conductor 54. Driver 52 is also connected to conductors 36, 38.

Circuit operation is monitored and the switching signal is computed in what is shown generally as a regulator 58, also referred to as computation means. The regulator includes an output voltage monitor or control loop 60, also joined to conductors 36, 38, which is responsive to the output voltage on conductor 44 for producing an error signal on a conductor 62. Monitor 60, may, of course, be connected to any portion of the supply which is responsive to the output voltage. Conductor 62 is joined to what is shown as an inductor current monitor and modulator 64. Monitor and modulator 64 receives what is referred to as a first signal indicative of the inductor current on a conductor 66. The inputs to the monitor and modulator are used to compute a switching signal which is transmitted optically via an opto-isolator isolation means to enabler 48. This transfered signal is shown in FIG. 1 as an isolator signal 68.

It should be briefly noted that a third letter-designated as terminal C is located on conductor 44. As will be explained further, later, connection of terminal A to terminal C instead of terminal B will result in a buck circuit configuration.

Describing now in more detail alternating current source 26, DC output conductors 42, 44 are connected to a switched resonant oscillator 70. The oscillator is connected to load 18 via AC output terminals 20, 22. Oscillator 70 includes a switch which is driven by a switch driver 72. The switch driver receives inputs from a power supply voltage monitor 74 which is connected to conductors 42, 44. Further, driver 72 receives input from computation circuit 75.

Computation circuit 75 receives input from a switch current monitor 76 which directly receives on a conductor 78 a signal from oscillator 70 indicative of the switch current while the switch is closed. Circuit 75 further receives control signals from an output voltage monitor 80. This monitor receives a reading of the output voltage on a conductor 82, computes a control signal, and sends it to circuit 75 over a conductor 84. Similarly, an arc current monitor 86 receives a reading of the arc current associated with fluorescent lamps forming load 18 over a conductor 88. A control signal is then computed for transmission to circuit 75 over a conductor 90. Computation circuit 75 also receives the previously mentioned dimming signal over conductor 32.

Completing the general discussion of ballast 10, remote control circuit 28 includes an oscillator 92 which produces a signal of rectangular pulses. These pulses are transmitted to a wave shaper 94 for producing a generally sawtooth-shaped waveform. This waveform is transmitted through an amplitude modulator 96 to an output amplifier circuit 98. This output signal is input to a ballast simulator 100 which feeds a signal indicative of ballast operation into an error amplifier circuit 102. Amplifier circuit 102 also receives as input a brightness demand signal on a conductor 104. The output of amplifier circuit 102 is transmitted to modulator 96. The output of amplifier circuit 98 is also fed to a transformer 106 (located in ballast 10) for transmitting the signal as an Electronic Off (EO) signal on conductor 30 to enabler 48 and also as a dimming signal on conductor 32 to computation circuit 75, as has been previously described.

CAM Power Supply

Figure 2A:
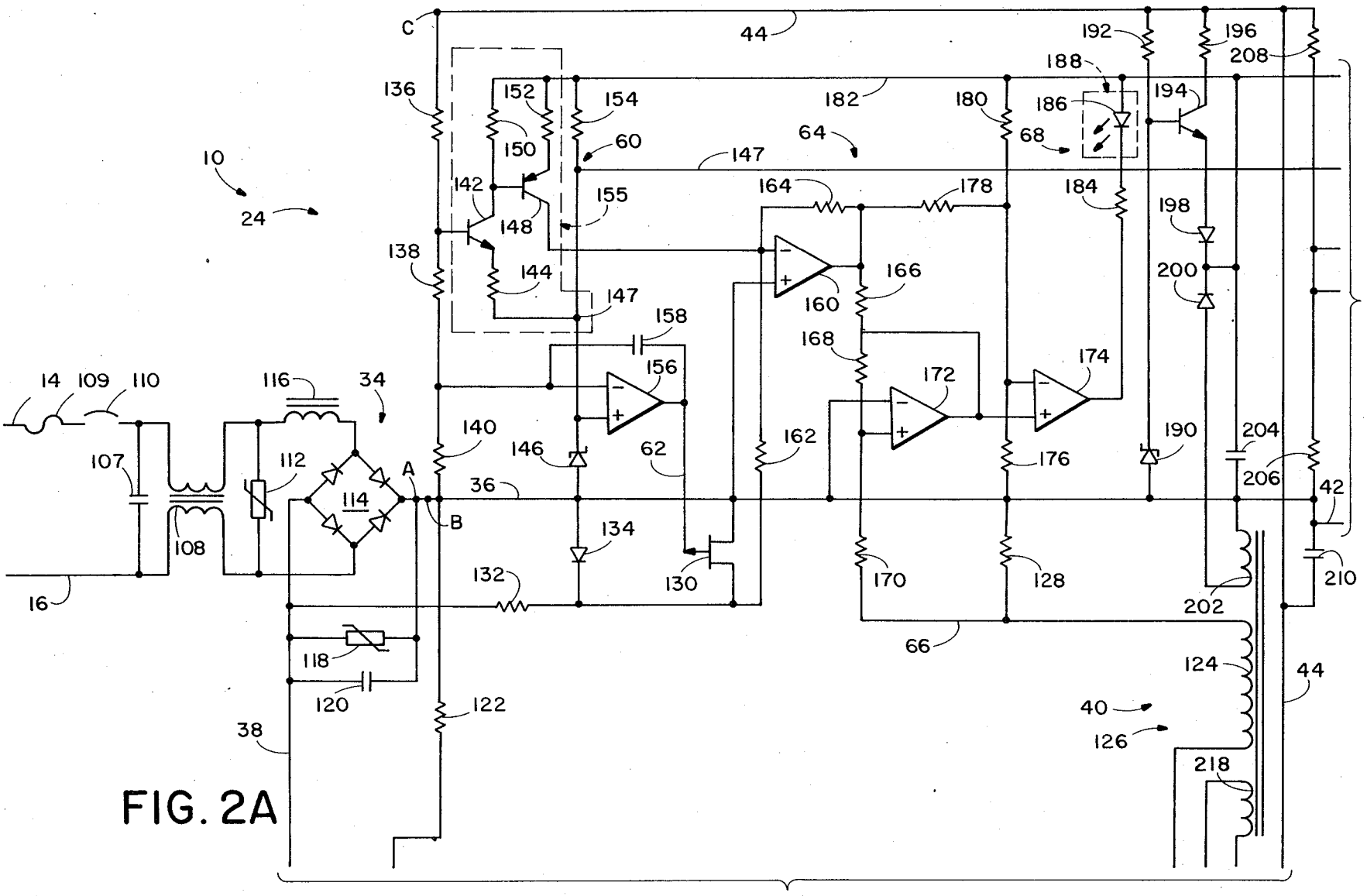

Referring now to FIG. 2, and particularly to FIG. 2A, input terminals 14, 16 are connected across a 4.7 nF capacitor 107 and to the input of a balun filter 108, with terminal 14 being connected through a fuse 109 and a thermal switch 110. The output of filter 108 is connected across a metal oxide varistor (MOV) 112 to a bridge rectifier 114 through a transient suppressing inductor 116, as shown. The output terminals of bridge 114 are connected to conductors 36, 38, across another MOV 118, and across a one microfarad capacitor 120. Conductor 36 serves as a ground for the circuit and is connected to switch control circuit 46 (shown generally on FIG. 2B) through a 16K ohm resistor 122. Conductor 36 is also connected through terminals A, B, described previously, to an inductor (inductor means) 124 forming part of a magnetic assembly shown generally at 126. Inductor 124 forms part of the switched inductor and energy storage circuit 40. The inductor is connected to conductor 36 through a 0.05 ohm resistor 128, also referred to as inductor-current sensing means.

MOVs 112 and 118 are mounted against thermal switch 110 such that they are in thermal contact with switch 110. The operation of this configuration will be further explained later herein.

Conductor 38 is connected to the drain of a voltage controlled resistor (VCR), (JFET) 130 through a 1M ohm resistor 132. The junction between VCR 130 and resistor 132 is connected to conductor 36 through a diode 134 (cathode to resistor 132). (All diodes are 1N4148 unless otherwise indicated.) Conductor 36 is further connected to output terminal 44 via a potential divider circuit comprising a 910K ohm resistor 136 (at conductor 44 end), a 3.3K ohm resistor 138 (center), and a 39K ohm resistor 140 (conductor 36 end).

The junction between resistors 136, 138 is joined to the base of an NPN (2N3904) transistor 142. The emitter of the transistor is connected to conductor 36 through a 1K ohm resistor 144 and a 5.1 volt zener diode 146, the anode of diode 146 being connected to conductor 36. The junction between resistor 144 and diode 146 is referred to as node 147. The collector of transistor 142 is connected to the base of a PNP (2N3906) transistor 148 and a 10K ohm resistor 150. The emitter of transistor 148 is connected to a 10K ohm resistor 152. Transistors 142, 148 and associated circuitry is also referred to as quick response means or circuit 155.

Node 147 is connected to a 3.3K ohm resistor 154 as well as to the non-inverting input of an (LM358) error amplifier 156. A 220 nF capacitor 158 is connected between the inverting input of amplifier 156 and its output. The inverting input is also connected to the junction between resistors 138, 140. The output of amplifier 156 is also connected to the gate of VCR 130. The drain of VCR 130 is connected to the inverting input of an (LM358) amplifier 160 through an 18K ohm resistor 162. The collector of transistor 148 is also connected to amplifier 160 inverting input. The non-inverting input is connected to conductor 36. A 220K ohm resistor 164 is connected between the inverting input and output of amplifier 160. The output of this amplifier is connected to the junction between inductor 124 and resistor 128 through a 10K ohm resistor 166 (at the output of 160), a 22K ohm resistor 168 (center), and a 1.5K ohm resistor 170. The junction between resistors 168, 170 is connected to the non-inverting input of a comparator (RCA 3290) 172. The inverting input is connected directly to conductor 36. The junction between resistors 166, 168 is directly connected to the output of comparator 172 which also is connected to the non-inverting input of a similar comparator 174.

The inverting input of comparator 174 is connected to conductor 36 through a 1K ohm resistor 176 and to the output of amplifier 160 through a 15K ohm resistor 178. It is also connected to resistors 150, 152, 154 through a 100K ohm resistor 180, as shown. The conductor joining these three resistors with resistor 180 is referred to as conductor 182. The output of comparator 174 is connected to conductor 182 through a 1.8K ohm resistor 184 and a light emitting diode 186 of an (H.P. 2502) opto-isolator shown generally and partially at 188. The anode of diode 186 connects to conductor 182.

A 15 volt zener diode 190 and a 100K ohm resistor 192 are connected in series between conductors 36, 44. (The anode of zener 190 connects to conductor 36.) The junction between the cathode of diode 190 and resistor 192 is joined to the base of an NPN SP 3439 transistor 194. The collector of the transistor is connected to output voltage conductor 44 through a 3K ohm resistor 196. The emitter is connected to a diode 198, the cathode of which is connected to the cathode of a (PLR 812) diode 200. The anode of this latter diode is connected to conductor 36 through an auxiliary winding 202 of magnetic assembly 126. The junction between diodes 198, 200 is connected directly to conductor 182 and also to conductor 36 through a 100 microfarad capacitor 204.

A potential divider exists between DC output terminals 42, 44 in the form of a 5.6K ohm resistor 206 connected in series with a 110K ohm resistor 208, which, in turn, connects to ground. This potential divider is connected in parallel with an energy-storage 220 microfarad capacitor 210.

Figure 2B:
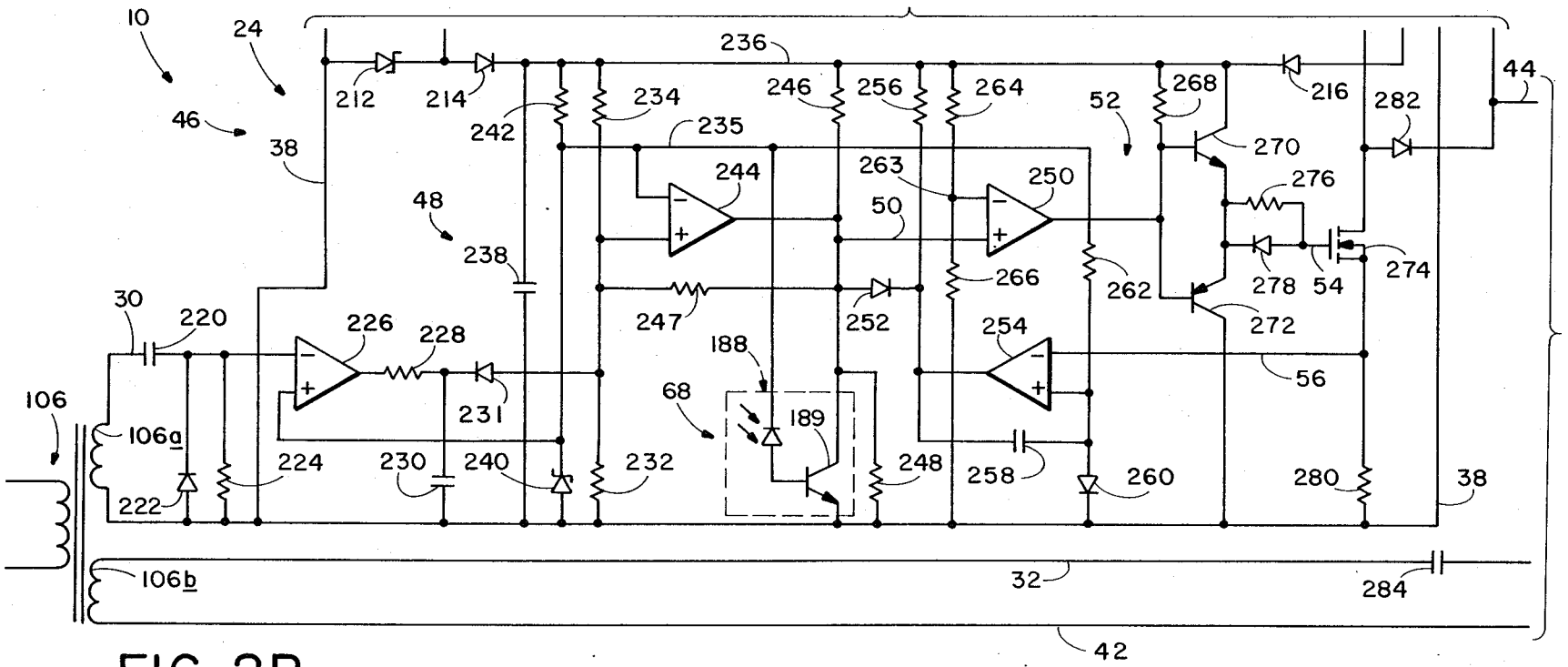

Referring now to FIG. 2B, initially in conjunction with FIG. 2A, a 10V zener diode 212 is connected between resistor 122 and conductor 38, with the anode of zener 212 connected to conductor 38. The cathode of zener 212 is connected to a diode 214 the cathode of which is connected to the cathode of a (PLR 812) diode 216. The anode of this latter diode is connected through another auxiliary winding 218 to conductor 38.

A secondary winding 106*a* of transformer 106 is connected between conductor 38 and a 100 nF capacitor 220. A diode 222 is connected in parallel with a 1M ohm resistor 224 and the combination of capacitor 220 and winding 106*a*. The cathode of diode 222 is connected to capacitor 220.

The common junction between capacitors 220, diode 222, and resistor 224 is connected to the inverting input of a (RCA 3290) comparator 226. The output of comparator 226 is connected to conductor 38 through a 1K ohm resistor 228 in series with a 100 nF capacitor 230. The junction between resistor 228 and capacitor 230 is connected to the cathode of a diode 231, the anode of which is connected to the junction between potential divider resistors 232 (100K ohm) and 234 (68K ohm). These two resistors are connected in series between conductor 38 and a conductor 236 which extends between diodes 214, 216. A 22 microfarad energy storage capacitor 238 also extends between conductors 38, 236. Additionally, a series connected 5.1V zener diode 240 and a 10K ohm resistor 242 also extend between these two conductors. The anode of zener 240 is connected to conductor 38. The cathode of zener 240 is also connected to the non-inverting input to comparator 226, to the inverting input of a (RCA 3290) comparator 244, and to the base or switch-driving terminal of opto-isolator switch 189 of opto-isolator 188. As can be seen, the emitter connection of switch 189 is connected to conductor 38, with the collector terminal connected to conductor 236 through a 12K ohm resistor 246.

The junction between resistors 232, 234 is connected to the non-inverting input of comparator 244 and also, through a 2.2M ohm resistor 247, to the collector terminal of switch 189, to the output of comparator 244, and to the non-inverting input of another (RCA 3290) comparator 250.

The output of comparator 244 is also connected through a diode 252 (anode to output of 244) to the output of a like comparator 254. The output of comparator 254 is also connected to conductor 236 through a 10K ohm resistor 256, as well as to conductor 38 through a 4.7 nF capacitor 258 and a diode 260, the diode having its cathode connected to conductor 38. The junction between capacitor 258 and diode 260 is connected to the non-inverting input of comparator 254 as well as to the cathode of zener diode 240 through a 220K ohm resistor 262.

The inverting input of comparator 250 is connected to the junction (node 263) between a 6.8K ohm resistor 264 and a 4.7K ohm resistor 266, which resistors are connected in series between conductors 38, 236, as shown, resistor 266 being connected to conductor 38.

The output of comparator 250 is connected to conductor 236 through a 6.8K ohm resistor 268, the base of an NPN (2N3904) transistor 270, and the base of a PNP (2N3906) transistor 272. The collectors of transistors 270, 272 are connected to conductors 236, 38 respectively. Their emitters are directly connected to each other and to the gate of (n channel 2×IRF 733 or 2×IRF 743) MOSFET switch 274, also referred to as first switch means, through two parallel connections each of a 470 ohm resistor 276 and a diode 278 (cathode to emitters), one pair connecting to each of the FET gates. The source of switch 274 is connected to conductor 38 through a 0.05 ohm current sense resistor 280. The drain of the MOSFET 274 is connected to DC output terminal 44 through an 8A, 500V (VARO TG86) diode 282 and to inductor 124, as shown.

Referring to the bottom portion of FIG. 2B, another auxiliary winding 106*b* in transformer 106 is connected on one side to conductor 32 which has a 100 nF capacitor 284 connected in line. The other end of winding 106*b* is connected to terminal 42.

Alternating Current Source

Figure 2C:
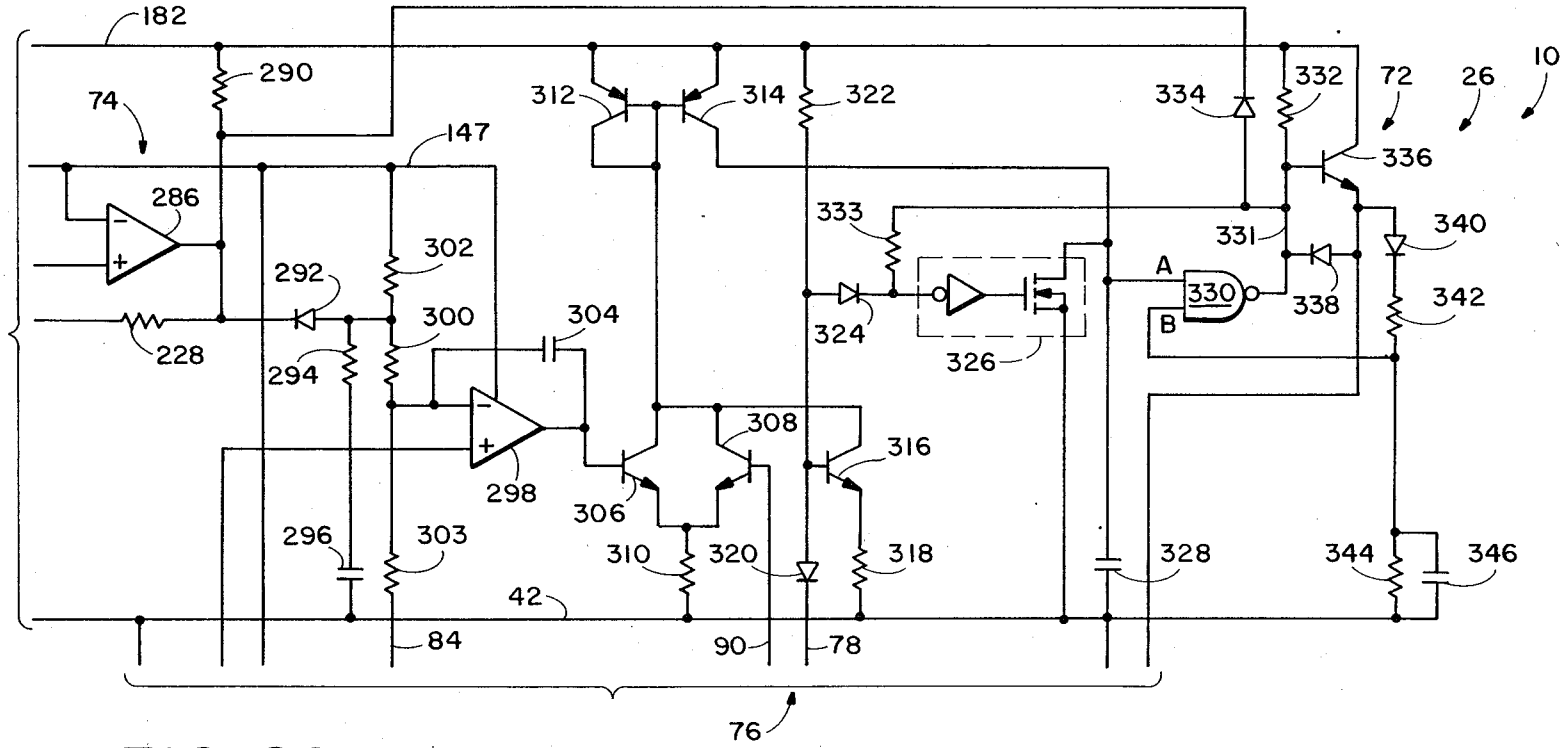

Describing now what may be considered the output stage of ballast 10 and referring initially to FIG. 2C, the junction between resistors 206, 208, shown in FIG. 2A, is connected to the non-inverting input of a (RCA 3290) comparator 286 and to the output of this comparator through a 100K ohm resistor 288. The inverting input of this comparator is connected to node 147. The output of the comparator is connected to conductor 182 through a 10K ohm resistor 290. The output is also connected to terminal 42 through a diode 292 (cathode to the output of comparator 286), a 1K ohm resistor 294, and a 2.2 microfarad capacitor 296. The junction between diode 292 and resistor 294 is connected to the inverting input of an (LM358) amplifier 298 through a 4.7M ohm resistor 300. Resistor 300 is connected in series between amplifier 298 and node 147, with a 47K ohm resistor 302. The inverting input to amplifier 298 is also connected to a 100K ohm resistor 303. The inverting input and the output of amplifier 298 are joined through a 100 nF capacitor 304.

The output of amplifier 298 is connected to the base of an NPN (2N3904) transistor 306, the collector and emitter of which are connected to the collector and emitter respectively, of a like transistor 308. The emitters of the two transistors are connected to conductor 42 through a 3.3K ohm resistor 310. The collectors of the two transistors are connected to the bases of two PNP (2N3906) transistors 312, 314. The emitters of these latter two transistors are connected to conductor 182. The collector of transistor 312 is connected to its base and to the collector of an NPN (2N3904) transistor 316, the emitter of which is connected to conductor 42 through a 3.3K ohm resistor 318. The base of transistor 316 is connected to the anode of a (600 V, PLR 818) diode 320. The base is also connected to conductor 182 through a 10K ohm pull-up resistor 322 and to the anode of a diode 324. The cathode of diode 324 is connected to the input terminal of a CMOS (open collector) buffer 326. The output of buffer 326 is connected through a 1 nF capacitor 328 to conductor 42. The output of buffer 326 is also connected to the collector of transistor of 314.

The collector of transistor of 314 is also connected to input of a CMOS (one-half of 40107) NAND gate 330, designated A in FIG. 2C. The output of gate 330 is connected to conductor 182 through a 4.7K ohm resistor 332, and through a 10K ohm resistor 333 to the input to buffer 326, and through a diode 334 to the output of comparator 286 (cathode of diode 334 connected to the output of comparator 286). Gate 330 output is also connected to the base of an NPN (2N3904) transistor 336, and through another diode 338 to the emitter of transistor of 336 (cathode of diode 338 connected to the output of gate 330). The collector of transistor 336 is connected to conductor 182. The emitter is also connected to conductor 42 through the series connection of a diode 340, a 2.2K ohm resistor 342, and the parallel connection of a 1M ohm resistor 334 and a 1 nF capacitor 346 (anode of diode 340 connected to the emitter of transistor 336). Resistor 344 and capacitor 346 are connected, in parallel, between another input, designated B in FIG. 2C, of NAND gate 330 and conductor 42.

Figure 2D:
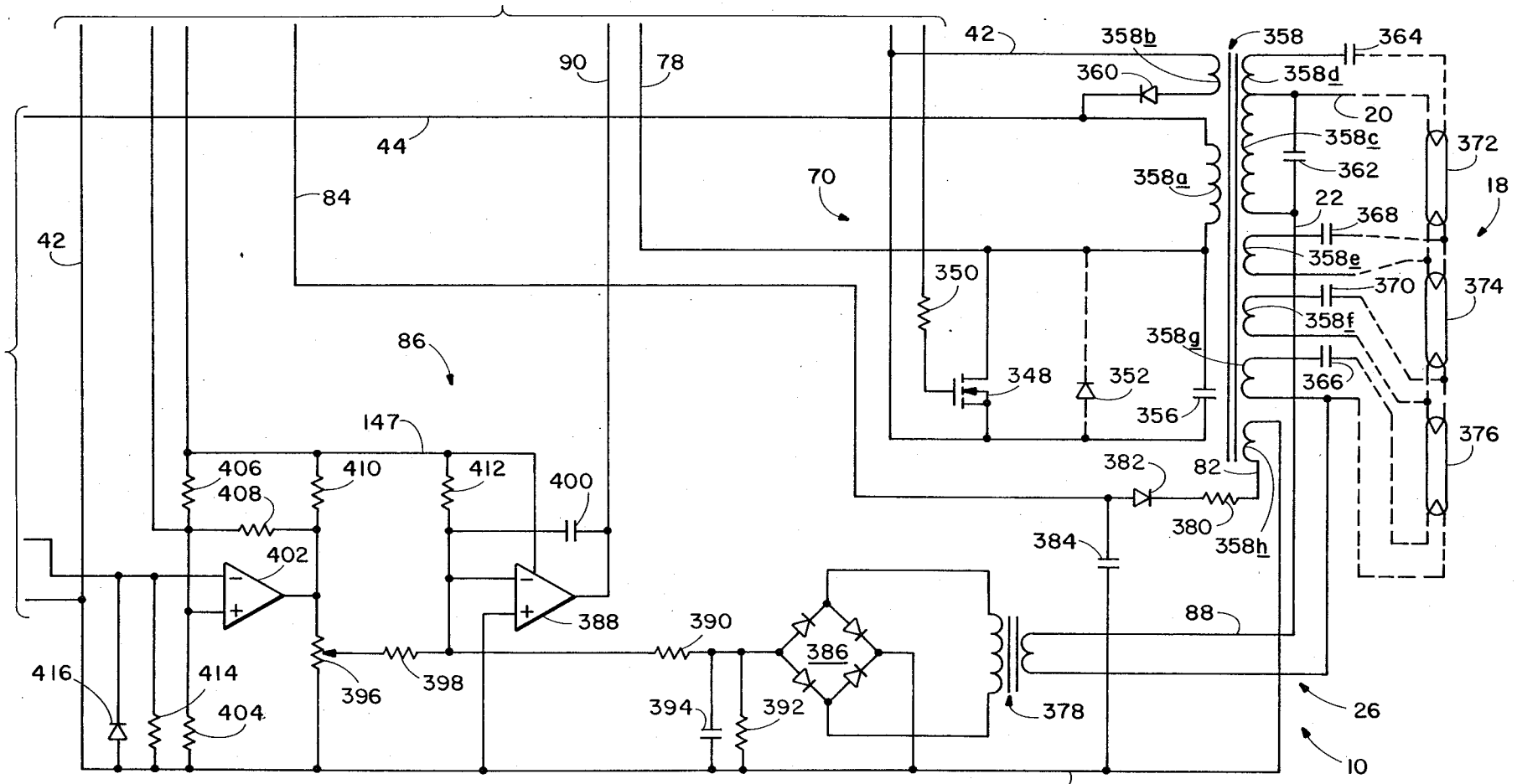

Referring now also to FIG. 2D, the emitter of transistor 336 is also connected to the gate of a MOSFET (n channel, 2×IRF 820) switch 348, also referred to herein as an oscillator switch or selective electrical coupling means, through a 2×47 ohm resistor 350, one resistor 350 connected to each gate of the two MOSFETs 348. The source of switch 348 is connected to terminal 42. The drain of the switch is connected to conductor 78 which is joined to the cathode of diode 320. A diode 352 and a 15 nF capacitor 356 are connected in parallel across the drain and source of switch 348, as shown. Diode 352 is shown in phantom lines to indicate that some switches, such as a power DMOS FET, includes such a diode as part of the device. If another form of switch means 348 is used, diode 352 must be a discrete, high voltage power diode.

Conductor 78 is connected through a primary winding 358*a* of a transformer 358 to DC output voltage terminal 44. Terminal 44 is also connected to DC output voltage terminal 42 through a (PLR 812) power diode 360 and in series with a second winding 358*b* on the primary limb of transformer 358. Transformer 358 also includes a series of secondary windings, specifically including a main output winding 358*c*, heater windings 358*d, e, f, g*, and a voltage sense winding 358*h*.

Winding 358*c* has a 2.7 nF, 1500 V capacitor 362 across its terminals. Heater windings 358*d, g*, have a 150 nF capacitor 364, 366, respectively, in series with one of their terminal windings. Similarly, windings 358*e, f*, are each connected to a 300 nF capacitor 368, 370, respectively. Capacitors 364, 366, 368 and 370 comprise what is referred to herein as power limiting means. A load 18 includes, in the embodiment shown, a series connection of fluorescent lamps 372, 374, 376. For this embodiment, these lamps would be of the T 12 40 watt RS type. The heater windings are connected to the lamp electrodes, as shown. Main output winding 358*c* is connected across the two end electrodes of the string of lamps with one of the leads passing through the primary winding of a current transformer 378.

Voltage sense winding 358*h* is connected at one end to conductor 42 and at its other end to conductor 84 (which connects with resistor 303 shown in FIG. 2C) through a 1K ohm resistor 380 and a diode 382, as shown (the cathode of diode 382 is connected towards winding 358*h*). Conductor 84 is also connected to conductor 42 through a 100 nF capacitor 384.

The secondary winding of transformer 378 is connected across a diode bridge 386. The positive output of this bridge is grounded at conductor 42. The negative output of bridge 386 is connected to the inverting input of an (LM358) amplifier 388 through a 47K ohm resistor 390. The non-inverting input of amplifier 388 is connected to conductor 42. The junction between resistor 390 and diode bridge 386 is connected to conductor 42 through the parallel connection of a 100K ohm resistor 392 and a 100 nF capacitor 394. The other end of resistor 390 is connected to the wiper of a 5K ohm potentiometer 396 through a 47K ohm resistor 398.

The output of amplifier 388 is connected to its inverting input by a 100 nF feedback capacitor 400 and to conductor 90 which is joined to the base of transistor 308, shown in FIG. 2C.

The end terminals of potentiometer 396 are connected between terminal 42 and the output of a (RCA 3290) comparator 402. The non-inverting input of comparator 402 is connected to a potential divider circuit including a 10K ohm resistor 404, connected to conductor 42, and a 3.9K ohm resistor 406 connected to node 147. The non-inverting input of comparator 402 is also connected to the non-inverting input of amplifier 298, shown in FIG. 2C. There also is a 1M ohm resistor 408 connecting the non-inverting input of comparator 402 to its output. The output of comparator 402 is connected to node 147 through a 10K ohm resistor 410. A 4.7M ohm resistor 412 is connected to the inverting input of amplifier 388 from node 147. Conductor 42 is connected to the other side of secondary winding **106*b* shown in FIG. 2B. Capacitor 284, also shown in that figure, is connected to the inverting input of comparator 402. A parallel connection of a 1M ohm resistor 414 and a diode 416 also connects the inverting input of comparator 402 to terminal 42, as shown (anode of diode 416 connected to conductor 42). This concludes a description of current source 26**.

Remote Control Circuit

Figure 3:
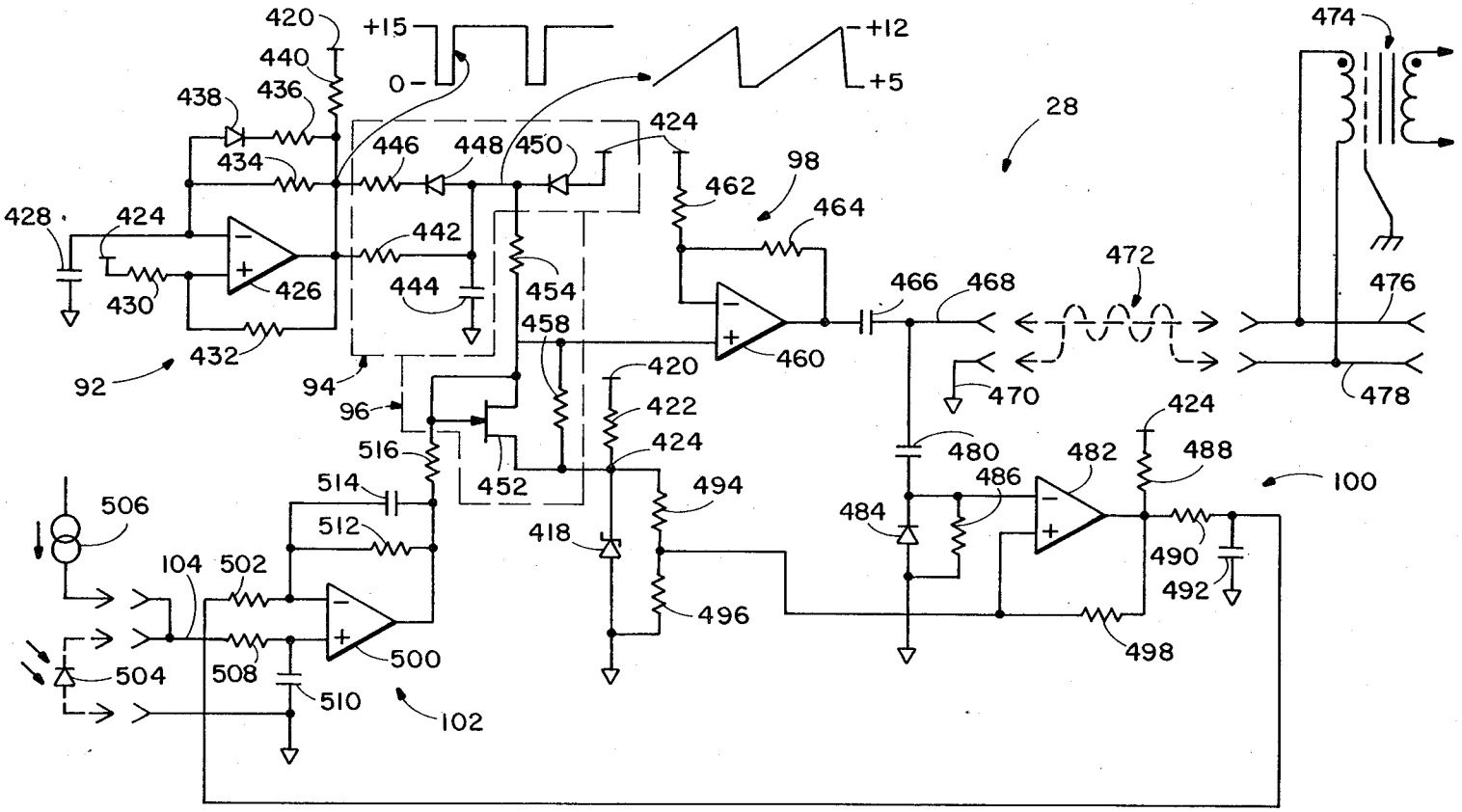
FIG. 3 is a schematic diagram of the remote control circuit of FIG. 1.

Referring now to remote control circuit 28, shown schematically in FIG. 3, the circuit is organized to operate from a single positive 15 V supply, node 420, such as readily may be generated using a small line transformer and rectifier. This supply does not have to be well regulated. A secondary reference supply of approximately +5 V is generated on a node 424 by a zener diode 418, the anode of which is connected to ground and the cathode of which is connected to the 15 V supply at a node 420 through a 1K ohm resistor 422. Oscillator 92 includes a (RCA 3290) comparator 426, the inverting input of which is connected to ground through a 100 nF capacitor 428. The non-inverting input is connected to the 5 V reference supply on node 424 through a 15K ohm resistor 430, and to the output of the comparator through a 100K ohm resistor 432. Comparator 426 output is connected to its inverting input through a 75K ohm resistor 434 and also through the series connection of a 4.7K ohm resistor 436 and a diode 438 (the cathode of diode 438 faces the output of comparator 426). The output of comparator 426 is also connected to node 420 through a 4.7K ohm resistor 440.

Wave shaper 94 includes a 36K ohm resistor 442 in series with a 100 nF capacitor 444 which connects the output of comparator 426 to ground. In parallel connection with resistor 442 is the series connection of a 2.7K ohm resistor 446 and a diode 448 (the cathode of diode 448 faces the output of comparator 426). The junction between diode 448 and capacitor 444 is connected to node 424 through a diode 450, having its anode connected to node 424.

The voltage between diodes 448, 450 is transmitted to amplitude modulator 96, which includes a voltage controlled resistor (VCR) 452, through a 10K ohm resistor 454, which is connected to the drain of VCR 452. The other terminal (source) of VCR 452 is connected to node 424. A 1K ohm resistor 458 is connected between the drain and source terminals of VCR 452.

The connection between the drain of VCR 452 and resistor 454 is also connected to the non-inverting input of an (LM358) amplifier 460. The reference voltage on node 424 is applied to the inverting input through a 1K ohm resistor 462. A 51K ohm feedback resistor 464 connects the output of the amplifier to its non-inverting input, as shown. The output of amplifier 460 is connected through a 10 microfarad capacitor 466 to an output terminal 468, of output terminals 468, 470 connected to a communication line 472. Line 472 is connected to the remaining ballast circuit shown in FIGS. 2A–2D, and specifically to transformer 106 through an isolating transformer 474. The communication line may also be connected to other luminaires at terminals 476, 478.

The output on capacitor 466 is also connected to ballast simulator 100 through a 100 nF capacitor 480. Capacitor 480 is specifically connected to the inverting input of a (RCA 3290) comparator 482. The inverting input of comparator 482 is also connected to ground through a parallel circuit of a diode 484 (inverting input of 482 to cathode of 484) and a 470K ohm resistor 486. The output of comparator 482 is connected to node 424 through a 2.7K ohm resistor 488 as well as to ground through the series connection of a 270K ohm resistor 490 and a 1 microfarad capacitor 492. A potential divider circuit, comprising the series connection of a 4.7K ohm resistor 494 and a 1K ohm resistor 496, is connected from node 424 to ground (resistor 494 is connected to node 424). The junction between these two resistors is connected to the non-inverting input of comparator 482, as well as to the comparator output through a 120K ohm resistor 498.

The junction between resistor 490 and capacitor 492 is joined to the inverting input of an (LM358) amplifier 500 through a 10K ohm resistor 502. In the embodiment shown, a photo diode 504, fed from a current source 506, is connected at its anode to ground and at its cathode to the non-inverting input of amplifier 500 through a 100K ohm resistor 508. That same amplifier input is also connected to ground through a 100 nF capacitor 510.

The inverting input and the output of amplifier 500 are joined through a parallel connection of a 1.2M ohm resistor 512 and a 100 nF capacitor 514. The amplifier output is also connected to the gate of VCR 452 through a 100K ohm resistor 516.

OPERATION

Cam Power Supply

Describing now the operation of ballast 10 and referring again to FIG. 2A, 2B in particular, the invention provides AC/DC power conversion while maintaining good input power factor, low line current distortion, good line and load regulation, low RFI immunity to line surges and transients, and extremely high efficiency. The embodiment depicted is a 120 V fluorescent ballast. Power conditions typical of fluorescent lighting systems are:

| | |
|---|---|
| Input Volts | 120, 60 Hz<br>220/240, 50 Hz<br>277, 60 Hz<br>Standby DC |
| Output Volts | 100–160 DC |
| Output Power | 80–1,000 Watts (Full power)<br>From 15 Watts (Dimmed)<br>Plus Electronic Off |
| Required Power Factor | Greater Than 0.95 |

The application of electrical power to line input terminals 14, 16 (AC or DC) causes a negative voltage to appear on conductor 38 relative to main circuit ground conductor 36. RFI is suppressed by capacitor 107 and any transient high voltage spikes on the supply lines are clipped by MOV's 112, 118. The circuit can also be operated on DC input power and in fact, because the peak currents would then be lower, efficiency would be even higher. Under the normal operating conditions of 60 Hz AC input, the voltage on conductor 38 is one-half sine wave raw rectified power, i.e., the modulus of the input supply voltage on terminals 14, 16, as shown by the upper waveform in FIG. 4. A DC voltage is established across capacitor 238, via resistor 122, diode 214 and zener clamp diode 212. This voltage is used as start up supply, on conductor 236, to support the electronics driving switch 274.

A reference voltage is generated at the junction between diode 240 and resistor 242, which will from now on be referred to as node 235. If the signal being received on conductor 30 from transformer 106 of the remote control circuit indicates that the ballast is to be operated in a normal mode (not in what will be referred to as Electronic Off mode as will be explained further subsequently), comparator 244 monitors the voltage on conductor 236, via potential divider resistors 232, 234. Hysteresis resistor 247 ensures clean operation of comparator 244. If this voltage on conductor 236 is high enough for correct operation of switch 274, comparator 244 enables the switch control circuitry. In this embodiment, switch 274 is a power FET, but in principal it could be any semiconductor switch capable of control from an electrical signal. (Note that the power FET switch is shown as two devices operated in parallel, however, any number of alternate devices may be used to provide the required current capability.

The gate of switch 274 is driven by a comparator buffer system, also referred to as switch driver 52, comprising comparator 250, transistors 270, 272, and resistors 268, 276, and diode 278. Resistors 264, 266 set a DC voltage level at the inverting input of comparator 250 (node 263) When the output of comparator 244 (conductor 50) is higher than the voltage at node 263, switch 274 is closed. When the voltage on conductor 50 is lower than that on node 263, switch 274 is open. It can be seen that conductor 50 carries a switching signal which ultimately is transmitted to switch 274.

Diode 278 is included to maximize the speed at which switch 274 opens. Resistor 276 damps any tendency for oscillations around the switch which may otherwise occur due to the impedance of current sense resistor 280. Once the circuit is running, the switching signal on conductor 50 comes from an opto-isolator switch 189. However, until the circuit is running, there can be no power available to drive the opto-isolator input diode 186, shown in FIG. 2A.

A bootstrap circuit, also referred to as bootstrap circuit means, is used to bring the circuit into its running condition. The circuit includes current sense resistor 280, comparator 254, diodes 252, 260, capacitor 258, and resistors 256, 262. Switch 274 is also referred to as switch means. Resistor 280, accordingly, is also referred to as means defining a reference switch means current.

When there is no current flowing through opto-isolator input diode 186, opto switch 189 is open (non-conducting). Pull-up resistor 246 then pulls voltage on conductor 50 high, closing switch 274. Resistor 248 is included to reduce the conduction required in the opto switch to turn switch 274 off. This saves power because opto-isolators are low efficiency devices and the current in diode 186 would have to be higher without resistor 248.

Comparator 254, diode 260, capacitor 258, and resistors 256, 262 form a retriggerable monostable latch. When no current is flowing in switch 274, diode 260 is forward biased by current through resistor 262 from node 235, establishing a reference voltage of approximately 600 mV at the non-inverting input of comparator 254. If current through switch 274 reaches a level such that the voltage across sense resistor 280 exceeds that across diode 260, then comparator 254 changes state, its output going from high to low. When the output of comparator 254 goes low, it pulls the voltage at conductor 50 low via diode 252, opening switch 274. When switch 274 opens, and current no longer flows in sense resistor 280, the inverting input of comparator 254 returns to zero volts. However, comparator 254 remains latched low because the potential at its non-inverting input is forced negative by capacitor 258, which attempts to hold constant charge as the comparator's output voltage goes low. This non-inverting input will remain low until current flow through resistor 262 has charged capacitor 258, bringing the voltage back to a positive level when the output of comparator 254 returns to its high state. The values of resistor 262 and capacitor 258, in conjunction with the voltages at conductor 50 and node 235 set the time period that the output of comparator 254 stays low. When the output of comparator 254 goes from its low to its high state, the charge on capacitor 258 changes rapidly because diode 260 conducts. These components, holding switch 274 open for a fixed period, are referred to collectively as means defining a delayed time interval.

When the output of comparator 254 returns to its high state, switch driver means 52 is again enabled, allowing switch 274 to reclose. This operation is repetitive with switch 274 current rising to a limit value and then the switch being held open for the fixed period of time. Each time switch 274 opens, the energy that has been stored in magnetic assembly 126 from the current flowing in inductor 124 is released via diode 282 to output capacitor 210. Auxiliary windings 202, 218 of magnetic assembly 126 provide power to the control electronics. Diode 252 allows the opto-isolator switch to control switch 274 once the circuit is running and comparator 254 is held high. This start up circuit gives a very fast over-current limit action and also obviates the need for slow or soft-start circuits.

The value of sense resistor 280 is chosen to latch the retriggerable mono low when switch 274 current is higher than any normal operating level but lower than that which will cause damage, saturation of magnetic assembly 126 or other undesirable effects. The mono period is then chosen to ensure sufficient energy is transferred to bring the circuit into its running condition. Additionally, continuous operation in the start cycle does not over-dissipate switch 274. If, for any reason, the current in switch 274 rises above its limit level, the mono will latch and open the switch within a very short time period. Since switch 274 current passes through inductor 124, the current rise is relatively slow, even when magnetic assembly 126 is nearing saturation. Hence, it becomes very unlikely that this current can ever reach dangerous levels.

By the same reasoning, even when a system is switched on at peak line voltage and capacitor 210 is fully discharged, the current will be limited to moderate levels. Therefore, there is no need to include any soft-start control. During the start cycle and once running, energy is taken from inductor auxiliary winding 218 via diode 216 to supplement the voltage at conductor 236. Energy is also taken via auxiliary winding 202, via diode 200, to energize the regulator portion of the control electronics, which will shortly be explained. This latter energy is stored in capacitor 204 and applied as a voltage to conductor 182. When sufficient voltage is present on that conductor, the regulation of the output voltage on output terminal 44 establishes control of switch 274 via opto-isolator 188.

Amplifier 156 produces what is referred to as an error signal on conductor 62 and therefore, in association with supporting circuitry, is referred to as error signal producing means.

Referring now particularly to FIG. 2A, the voltage on terminal 44 is applied to the potential divider comprising resistors 136, 138, 140. The resulting voltage, referred to as a fourth signal, across resistor 140 (referred to, in combination with resistors 136, 138, as means for generating the fourth signal) is compared against a reference voltage on node 147, by error amplifier 156. The node 147 reference voltage is derived from zener diode 146 referred to as a third signal indicative of a desired output, using current fed from conductor 182 via resistor 154. Zener 146 is also referred to as means for generating the third signal.

The output of error amplifier 156 is the time integral of the difference between the output voltage at terminal 44 and the reference voltage on node 147. Integration of the difference is promoted by capacitor 158, also referred to as integrator means. The error signal on conductor 62 is modulated by the voltage on conductor 38 (raw rectified line voltage). This modulation determines the relationship between the line current and line voltage. The opportunity is there to tailor the current waveform to any desired shape; but for a good power factor, sine wave current is desired. There is some merit in flattening the crest so that peak currents are reduced. This flattening is provided by diode 134 which extends between the source and drain of voltage controlled resistor 130. Diode 134 also sets an absolute maximum line current peak.

For an input current that follows the input voltage, the modulation function has to be the product of the output of amplifier 156 and the voltage on conductor 38. In this embodiment, modulation is achieved by VCR 130, resistor 132, and diode 134 (referred to as modulation means). The output from this modulation circuit, from resistor 132 and VCR 130 drain is applied to the inverting input of amplifier 160 via resistor 162. The circuitry producing the inputs to amplifier 160 are referred to as adjustment means. Resistor 162 sets the gain of amplifier 160 in conjunction with resistor 164. The output of amplifier 160 is a voltage of positive, full-wave rectified sine waves when the typical sine wave input line voltage is applied. Its amplitude is modulated to be larger when the output voltage is lower than desired. A representative waveform, referred to as a second signal indicative of the desired maximum inductor current, is shown for the output of amplifier 160 by the middle waveform in FIG. 4. The larger waveform shows the clipping which is provided by diode 134 to limit the maximum value for the output of amplifier 160, and therefore as will be seen, the value of current in inductor 124. The lower wave forms shown for amplifier 160 output illustrate, generally, what could be considered a minimum level of output.

When switch 274 is closed, current rises in inductor 124 and a voltage develops across sense resistor 128. Comparator 172, having an open collector output, is high, and amplifier 160 feeds current through resistors 166, 168, 170, establishing a voltage across resistor 170 nominally proportional to the output voltage of amplifier 160. The circuitry contributing to this voltage is generally referred to as reference voltage generating means.

When the voltages across resistors 128, 170 become equal and offsetting, the voltage at the non-inverting input of comparator 172 will be zero. At this time, comparator 172 changes to its low state. Its output sinks the current from resistor 166, dropping its non-inverting input negative, and latching its output low. When comparator 172 goes low, it drives comparator 174 low as well, turning opto-isolator diode 186 on, via resistor 184.

Resistors 176, 178, 180, set a reference voltage on the inverting input of comparator 174. Resistor 178 is required since the output low and high levels of comparator 172 vary with varying voltage of the output of amplifier 160. The inclusion of resistor 178 insures that these high and low levels always straddle the reference voltage into comparator 174. That is, the output of a comparator is normally assumed to have two defined levels —high and low— each of which would be a fairly well defined voltage. However, comparator 172 has high and low output levels which vary with the output of amplifier 160. This makes a single reference level into comparator 174 impractical. Resistor 178 slides the reference voltage into comparator 174 up as amplifier 160's output rises. It should be noted that the function provided by comparator 174 would be obtained at a second output from comparator 172 if the circuit is implemented on silicon. This would greatly reduce the component count and complexity.

Opto-isolator diode 186 turning on closes opto switch 189 causing switch 274 to open. Opto-isolator 188 thus serves as signal transfer means. This of course assumes that the circuit is in its normal operating condition and monostable comparator 254 is static in its high state.

Figure 4:
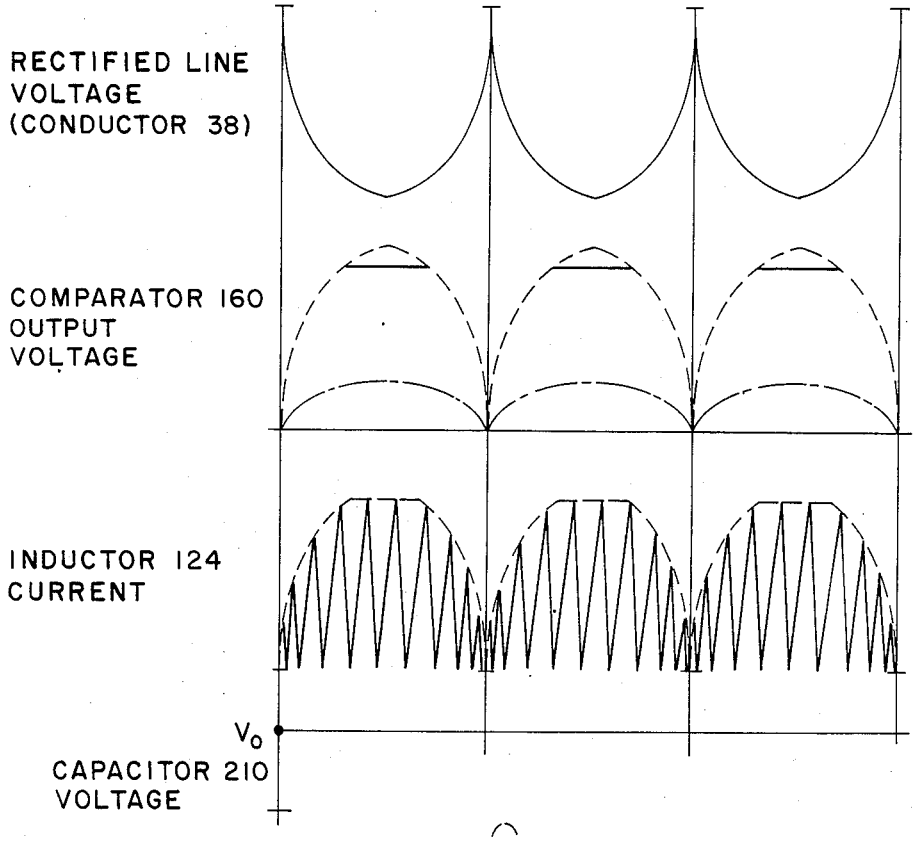
FIG. 4 illustrates selected waveforms of the power supply of FIG. 1.

The opening of switch 274 releases energy stored in inductor 124 into output capacitor 210, via diode 282, as has been described. Capacitor 210 and diode 282 form, in combination, an energy storage means. This flow of energy causes the current in inductor 124 to fall towards zero. As it crosses through zero, which it will always do since the system has some finite capacitance, comparator 172 changes back to its high state, causing switch 274 to close. This cycle repeats with the peak inductor current being controlled higher when the output voltage, as sensed on conductor 44, is lower than desired. Conversely, when the output voltage is higher than desired, the inductor current is controlled lower. There is thus output voltage regulation. This, it should be noted, is an important feature of the present invention. As can be seen in the current waveform for inductor 124 as shown in FIG. 4, in simplified form for purposes of illustration, the inductor current peak is limited and follows the modulating peak reference provided by the output of amplifier 160 shown immediately above. The inductor current envelope is amplitude modulated in phase with the input line voltage modulus.

As part of output voltage monitor 60, quick response circuit 155 provides means for increasing the bandwidth whenever the output voltage is greater than a predetermined level, by additional control on the output of amplifier 160. In the event of rapid fluctuations of load or line voltage causing the output voltage to rise above an acceptable limit, this circuit feeds positive current, a control signal, to the inverting input of amplifier 160, putting the regulator at its minimum power level. The inputs to this fast response circuit are the reference voltage at node 147 and the output voltage as indicated at the junction of resistors 136, 138, also referred to herein as means for sensing the output voltage.

Figure 6:
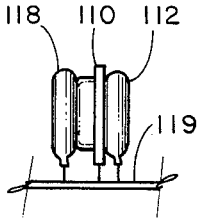
FIG. 6 is a plan view of a thermally activated safety switch of the invention.

The two metal oxide varistors (MOVs) 112, 118 are included to absorb energy when high voltage surges appear on the input power line. These MOVs, also referred to herein as heat-generating elements, cannot, however, absorb infinite amounts of energy and will burn out if the line voltage rises to a level where they conduct for extended periods. To prevent this, they are thermally coupled to thermal switch 110 so that it will open as the MOV temperature starts to rise. Referring now to FIG. 6, a plan view of the arrangement of MOV 112, 118, and thermal switch 110 is depicted as the components may be arranged on a circuit board 119.

Switch 274 can only be opened by opto-switch 189 when sufficient voltage is present on conductor 182. It is therefore important to ensure that the output voltage cannot rise too high when there is insufficient voltage on conductor 182. To cover this requirement, an energy feed is included from capacitor 210 to conductor 182. This function is achieved by transistor 194, diode 198, resistors 192, 196, and zener diode 190. Resistor 192 and zener 190 set a voltage at the base of transistor 194 slightly below the normal voltage level of conductor 182. Transistor 194 and diode 198 then conduct if the voltage at conductor 182 falls too low while the output voltage is at a sufficient level. Resistor 196 is included to limit the current and dissipation in transistor 194. When the voltage at conductor 182 is normal, transistor 194 is biased off. Diode 198 protects the base emitter junction of transistor 194 from excessive reverse voltage during power down (switching off line power). When the load connected to the output voltage on capacitor 210 is very light, the regulator has to hold switch 274 open for most of the time, which starves the supply on conductors 182, 236, of energy from auxiliary windings 202, 218. In this situation, conductor 236 receives power directly from the supply through diode 214. Conductor 182 gets power through transistor 194.

In another feature of the preferred embodiment, a signal is fed from remote control circuit 28 through isolating transformer 106 to comparator 226 in order to put the circuit into what is referred to as an Electronic Off (EO) mode. In this mode, the circuit has normal input line voltage applied, but does not consume more than a few percent of its normal power. EO is controlled by applying an amplitude modulated AC signal via transformer 106 to a clamp circuit including diode 222, capacitor 220, and bleed resistor 224. These clamp components DC reference the negative peak of the AC signal to the conductor 38 potential. Then, if the positive peaks exceed the voltage at node 235, comparator 226 goes low. This comparator is diode OR'ed via a noise rejection filter to the non-inverting input of comparator 244. The noise rejection filter includes resistor 228 and capacitor 230. When the output of comparator 226 is low, it forces comparator 244 low, thereby opening switch 274. All circuitry is then inactive except for that connected to conductor 236, which is a minimal power situation.

This substantially completes a description of what is referred to as the current amplitude modulated (CAM) power supply stage of ballast 10. A few additional comments regarding the use of the supply are appropriate. When operating at unity power factor with sine wave input current, PWM power supplies loose efficiency as line voltage rises. Also, due to the critical nature of the relationship between operating frequency and component values, including load, the design has to be tailored to the the supply voltage and to the presence of either a buck or a buck-boost system. The CAM power supply does not have these problems. The already higher efficiency remains high even when line voltage is varied well away from normal levels.

Also, due to its self-compensating operation, the CAM power supply can be connected to run buck or buck-boost simply by changing a link. Referring again FIG. 2A, terminals A and B on conductor 36 and terminal C shown on output terminal conductor 44 represent terminals usable for changing the circuit, shown in a buck-boost topology, to a buck topology. This conversion is made simply by disconnecting terminal A from terminal B and reconnecting it to terminal C on conductor 44.

The buck converter does not conduct until the line voltage on conductor 38 is greater than the output voltage occurring at terminal 44. Therefore the multiplier does not need to have the line voltage as its modulation input. Being a single quadrant multiplier, the negative product does not appear at its output. The line current will still be a near sine wave with small zero current periods near the line voltage zero instants. The ideal value of inductor 124 for a 277 V buck converter would be somewhat larger, for the same minimum operating frequency, than that for a 120 V buck-boost converter (as shown in FIG. 2A), each outputting 120 V. However, even if the inductor value is kept the same for the two circuits, the frequency shift would be only approximately 15%.

Provided the voltage and current ratings of capacitor 210, switch 274, diode 282, inductor 124, and other associated components are adequate, a single assembly could run on, either 120 V or 277 V simply by moving a link or switch. There could be advantage in a 277 V, 60 Hz system if a relay was used to switch such a link to run at 120 V DC standby. In practice, it would be preferable to manufacture dedicated buck and buck-boost supplies, but from a largely common set of subassemblies.

Alternating Current Source

In this particular embodiment, the CAM power supply drives a dimmable fluorescent lamp output stage. This output stage is designed to drive either two or three rapid start 40 W lamps at arc currents up to 380 milliamps, with unmodulated power at approximately 70 K Hz. The main output is a current source controlled by feedback and programmed either by an AC analog voltage from transformer 106 or by potentiometer 396. Auxiliary outputs are provided to power the lamp heaters. Following the practice recommended by the lamp manufacturers, the output rises slowly from zero volts, giving the heaters in the lamps time to raise the electrodes to the correct temperature, then going to higher voltage to strike arcs in the lamps. Once the arcs have established, the ballast goes into constant current mode in order to ballast the lamps.

Referring now particularly to FIGS. 2C, 2D, transformer 358, transistor switch 348, and capacitors 356, 362 form switched resonant oscillator or series resonant mode power oscillator 70. This is a particularly efficient DC to AC converter. It also provides the electrical isolation between the line power input and the output leads, which is necessary to satisfy UL safety requirements. Heater windings 358*d, e, f, g* and voltage sense winding 358*h* are tightly coupled to main output winding 358*c* so that the voltages are proportional. This causes the heater voltages to be higher when the arcs are not struck, and lower when the output voltage is reduced by the low arc impedance. At maximum arc current, the arc voltage is at its lowest, and it rises somewhat as the arc current is reduced. Fortunately, the heater power needs to follow this same trend. That is, the heater power should be highest when the arc is not struck and low at full arc current when electron bombardment heats the electrodes. It should rise again at lower arc currents when the bombardment heating is less.

The inclusion of capacitors 364, 366, 368, 370, described hereunder, also causes an increase in heater power as the lamps are dimmed. This occurs because the frequency of the output power increases as the ballast dims and each capacitor presents a lower impedance to the heater currents. While this effect is not large, the total change in heater power as the ballast output goes from minimum to maximum power, represents a worthwhile saving in power.

Heater winding 358*d* is connected to one end of winding 358*c* so that the arc current flows via the heater wires. Windings 358*e, f* are isolated from all other circuit nodes, allowing their potentials to be set by the lamp arc voltages. Winding 358*g* is connected to the other end of winding 358*c* through current transformer 378. This transformer is used to sense the arc current so that it can be controlled by a feedback loop.

Capacitors 364, 366, 368, 370 are included in series with each of the heater windings so that if any of the heaters are short-circuited, excessive current does not flow and damage the ballast or cause a fire risk. The capacitor values are chosen to have suitable impedances at normal heater currents. It should be noted that because ballasts are high output power devices, the usual practice of simply adding heater windings to the main output transformer can be very dangerous. A shorted heater output can draw extremely high current under certain conditions, such as with one or more lamps removed. The capacitors also limit the tendency for high inrush currents into cold, low resistance heaters when power is first applied. These inrush currents are one of the most common causes of filament failures.

Primary winding 358*a* of transformer 358 is placed on a separate yoke of the ferrite core and the ferrite is shaped such that there is a large leakage inductance. This leakage inductance resonates with capacitor 362 giving nearly pure sine wave output current and voltages to drive the lamps. It also stores energy put into the transformer while transistor switch 348 is closed. When the switch opens, capacitor 356 also resonates with the leakage inductance and the energy stored is given up to the load. The transformer leakage inductance and capacitors 356, 362 are arranged to give the desired operating mean resonant frequency and Q. The circuit Q must be high enough to ensure that, under all load and power levels, when switch 348 is open, the voltage across it will fall back to zero or below. However, if the Q is too high, the efficiency will suffer due to the extra circulating currents within the resonating components.

Figure 5:
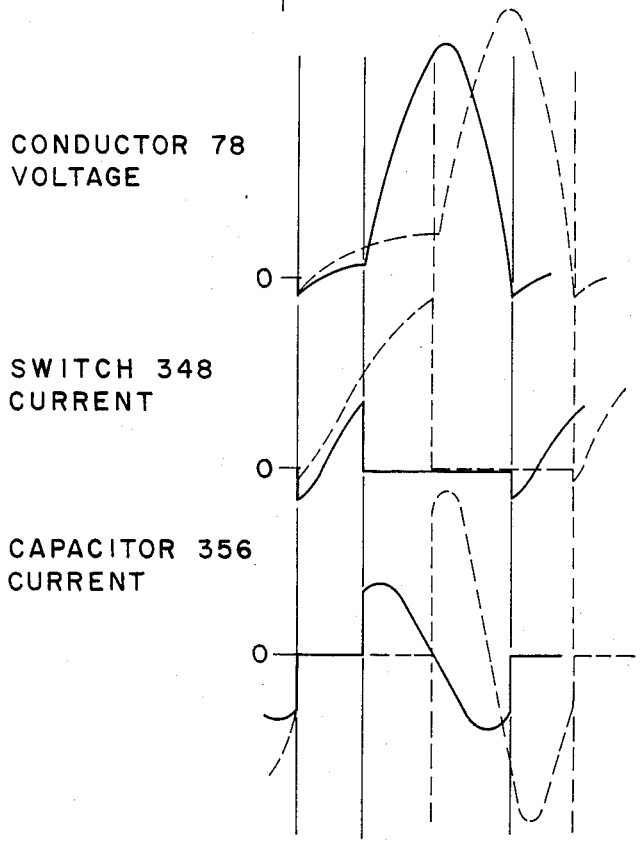
FIG. 5 illustrates waveforms associated with the current source of FIG. 1.

The waveform shown in FIG. 5 will help to illustrate the operation of this power oscillator. When switch 348 is closed, current flows from the DC supply at terminal 44 through the transformer primary 358*a* and switch 348. The current waveform during this period is determined by the supply voltage, the leakage inductance, and the impedances reflected to the primary winding from the various secondary windings. As this current rises, energy is stored in the transformer and is also passed into the load and capacitor 362 by the transformer action.

When switch 348 is open, the stored energy maintains a resonant flow of current, putting further energy into the load, and causing a current flow in capacitor 356. At the instant the switch opens, capacitor 356 is virtually discharged, having only the saturation voltage of the switch across its terminals. The resonant current from conductor 78 which was flowing in switch 348, now flows in capacitor 356. This causes an initial voltage rise. As the resonating current changes direction into its negative half cycle, the voltage at conductor 78 falls. If the Q of the circuit is high enough, as is provided by the preferred embodiment, the voltage will come down to zero. Assuming that the Q is greater than the critical value required to just bring conductor 78 down to zero, negative current will still be flowing. This negative current opens diode 352 clamping the voltage just below zero until the current rises once more into its positive half cycle. The voltage on conductor 78 is shown in FIG. 5. The solid line waveform represents a lower output power situation than does the dashed line waveform.

For correct operation of the power oscillator, switch 348 must reclose after the voltage on conductor 78 reaches zero, and before it rises again. Examination of this system will show that the power dissipation in switch 348 is very low. As it opens, there is a discharged capacitor across its terminals which holds the voltage low until well after all switch current flow ceases. As it closes, the voltage has been brought back very near to zero by the action of the resonant circuit. This is particularly shown in the middle waveforms of FIG. 5.

The operating power level can be controlled by opening the switch at the current level which will give the desired power. The control signal to turn switch 348 on and off can be readily derived from the voltage on conductor 78. The ideal instant to close the switch is when the voltage on conductor 78 crosses zero going negative. Since the switch has some finite resistive impedance, a small voltage analog of the switch current appears on conductor 78 while the switch is closed. This provides the necessary feedback information for proper switch control. Switch 348 is controlled by the voltage on conductor 78 and a power demand signal, as represented by the drain current from transistors 306, 308, as will now be described.

Gate 330 is an open collector NAND gate which drives switch 348 via buffer components comprising transistor 336, diode 338, and resistor 332. When either of the inputs to gate 330 is low, its output will be open allowing pull-up resistor 332 to take node 331 toward conductor 182 voltage. Emitter-follower transistor 336 pulls the gate of switch 348 positive, via resistor 350, turning switch 348 on. When both of the inputs to gate 330 are high, its output transistor comes on pulling node 331 low, and taking the gate of switch 348 low, turning it off. As this happens, the current flow necessary to discharge the gate capacitance of switch 348 passes through diode 338. Transistor 336 is thereby biased off. Resistor 350 is included to prevent parasitic oscillation around switch 348.

Input B of gate 330 is normally high. The gate is a Series B CMOS device supplied with voltage from conductor 182. An input level which is nominally 45% or less of conductor 182 voltage will give a high output. A 55% or more input will produce a low output.

Input A of the gate is connected to an integrating amplifier including transistors 312, 314, 316, resistor 318, capacitor 328. Capacitor 328 is discharged by 326 each time switch 348 closes. This reset function, to be explained further shortly, occurs during a short period of conduction by the open collector output of CMOS buffer 326. After this short period, the buffer's output goes open (high), leaving capacitor 328 discharged. Hence, input A of gate 330 is at zero volts. So long as input A of gate 330 stays below about 55% of the conductor 182 voltage, switch 348 will stay closed.

As described previously, when switch 348 is closed, the voltage on conductor 78 is an analog of the switch current. This voltage is connected to the input of the integrating amplifier (the base of transistor 316) via diode 320 and pull-up resistor 322. The diode and resistor are required to prevent the very large voltages at conductor 78, when switch 348 is open, from damaging transistor 316. As the current rises in switch 348 and the voltage on conductor 78 follows, a similar voltage (one diode drop higher) will appear at the base of transistor 316. This results in a voltage across resistor 318 nominally equal to the voltage on conductor 78. The base-to-emitter voltage of transistor 316 cancels the voltage drop across diode 320.

Since transistors 312, 314, 316 are all high beta transistors, the current in resistor 318 is mirrored by a similar current in the collector of transistor 316. This collector current flows through the emitter-base junction of transistor 312, causing a voltage to develop at the base-emitter junction of transistor 314. Since these latter two transistors are of matched characteristics, the collector current of transistor 314 establishes at the same level as the current in the collector of transistor 316 and resistor 318. There is thus now a collector current in transistor 314 which is an analog of the current flowing in switch 348. Assuming for the moment that no current flows in the collectors of transistors 306, 308, a rising voltage appears at input A of gate 330 as capacitor 328 charges. This voltage will be the time integral of the current in switch 348, rising faster when the switch current is higher. As the voltage at input A of gate 330 goes above 55% of the voltage on conductor 182, the switch is opened. It follows that the higher the switch current, the sooner switch 348 will open (constant time integral).

If current from the collectors of transistors 306, 308 is considered, it will be apparent that the greater this current (which is added to that from transistor 316) the sooner switch 348 will be opened. Clearly lesser currents from these transistors will leave it to open later. These currents are controlled by feedback loops to control the power at which the series resonant mode power oscillator runs. The necessary reset function to discharge capacitor 328 at the instant switch 348 closes, is achieved by CMOS buffer 326, diode 324 and resistor 333.

As the voltage on conductor 78 falls back to zero, diode 320 pulls the anode of diode 324 down to zero volts. Since node 331 voltage is low (switch 348 open), resistor 333 will pull the input of buffer 326 low, causing its output transistor to discharge capacitor 328. As soon as the input of gate 330 drops, its output opens allowing node 331 to rise. Resistor 333 then pulls the input of buffer 326 high, opening its output. The finite propagation delay through buffer 326 and gate 330, with a resistor feeding the capacitance of buffer 326, is long enough to ensure capacitor 328 is completely discharged.

Again, buffer 326 is open, leaving the integrator free to run. When the input A of gate 330 reaches 55% of the voltage on conductor 182, and the voltage on node 331 falls, the input voltage of buffer 326 does not fall far enough to turn it on before the opening of switch of 348 causes the voltage to the anode of diode 324 to rise. This holds the output of buffer 326 open until the voltage on conductor 78 again drops to zero.

If for any reason the voltage on conductor 78 stays high and there is no energy stored in transformer 358 or capacitors 356, 362, to return it to zero, switch 348 would not close again. To prevent this possible problem, a start/restart circuit, comprising resistors 342, 344, diode 340, and capacitor 346, is added.

Under normal running conditions, the emitter of transistor 336 goes high every time switch 348 is on. This is about every ten to fifteen microseconds. This charges capacitor 346 via diode 340 and current-limiting resistor 342. This holds input B of gate 330 high. However, if the circuit stops running with switch 348 open, the emitter of transistor 336 must be low. Capacitor 346 will eventually discharge through resistor 344, which resistor has a high value giving a long time constant with the capacitor. When capacitor 346 discharges and brings input B of gate 330 below 45% of the voltage on conductor 182, switch 348 closes and its current rises, causing normal operation to start or be restored.

Since transistor switch 348 is turned off earlier by higher switch current, it tends to be well protected from damage by excessive loading. However, it is possible to cause the peak of the voltage excursion when the switch is open to exceed its maximum rating. This could happen, for instance, if the load was suddenly removed when the output stage was at full power and the voltage on terminal 44 was at a high level. Winding **358*b* and diode 360 are included to prevent this possible cause of failure. The winding is on the primary core of transformer 358 and is connected via diode 360 between terminals 42, 44. Since windings 358*a*, *b*, are tightly coupled, their ratio defines a voltage on conductor 78 above which diode 360 will open, thereby generating a clamping signal. This clamps the conductor 78 voltage by dumping energy from the primary core of transformer 358 into capacitor 210**.

When line power is first applied to the ballast, or when it comes out of Electronic Off mode, the voltage on terminal 44 is too low to ensure correct operation of current source 26. Therefore, comparator 286, described previously, is used to monitor the voltage on terminal 44. When it is below the adequate level, the output stage (current source 26) is held in a non-operational state (disabled). When comparator 286's output is low, diode 334 pulls node 331 low whatever the state of the output of gate 330. This holds switch 348 open, preventing the output stage from running. When the voltage on terminal 44 becomes sufficient, the output of comparator 286 goes high. This lets the start circuit, containing resistors 342, 344, diode 340, and capacitor 346, operate to start normal operation. The potential divider provided by resistors 206, 208 is used to sample the voltage on terminal 44. Comparator 286 then compares this sample with the reference voltage on node 147. Resistor 290 is a pull-up resistor on the open-collector output of comparator 286. This is required so that resistor 288 can add hysteresis to the comparator function and prevent it from following the ripple voltage on terminal 44, which has a frequency twice that of the line frequency.

This load switching by comparator 286 and the associated circuitry contained with power supply voltage monitor 74 ensures that the CAM power supply is only lightly loaded until the output voltage on terminal 44 reaches a level near the normal operating level. This minimizes the power required during the CAM power supply start sequence.

Output Voltage and Arc Current Control

The standards set by lamp manufacturers and Underwriters Laboratories (UL) for correct lamp operation and safety require that, during startup, the heater voltages from the heater windings on transformer 358 should rise, the lamp voltage between windings 358*d* and 358*g* should then rise toward that level required to strike the arcs in the lamps, taking at least 300 milliseconds to do so. This gives the heaters enough time to establish the correct electrode temperatures. If for any reason, such as the lamps not being properly fitted, the arcs do not strike, the lamp voltage then must be limited at some defined level for safety. This is referred to as the open-circuit voltage of the ballast.

In the normal event in which the lamp arcs strike, the lamp load then becomes a negative resistance at all current levels other than below about 1 mA where it has positive resistance. This negative resistance load obviously has to be fed from a positive resistance (current) source. Prior ballast art has taught the provision of a fairly finite source impedance, sufficient to prevent serious variations in arc current. The advent of electronic ballasting enables one to achieve a very much higher source impedance. Hence, not only is the arc current controlled much better, giving more predictable light output, but a wide range of lamps may be fitted to the same ballast. For instance, if the ballast were to be designed to give a certain output current with a near infinite output impedance (perfect current source), then, in theory, any number of lamps, in series, could be driven. In practice, two or three lamps of the same or various wattage rating can be driven by this ballast provided all the lamps require the same arc current.

Since the arc current is varied to control dimming, a simple limit to maximum current will allow lower current lamp types to be used with a high current ballast. The practical limit to the range of lamps that can be driven, is controlled by the heater voltage variations, since the simple method of generating heater volts is to add a few turns to the output transformer which are tightly coupled to the main output winding. Then, since the arc voltage is nominally constant and predictable, the heater voltage is adequately controlled. If control of too large a range of lamps is attempted, the heater voltage range would be exceeded with adverse effects on lamp performance and life. Of course, if a separate heater transformer was provided, this limit would be removed.

In order to control the output voltage and arc current as defined above, each of these parameters has to be monitored within the ballast. Output voltage is monitored by a sense winding 358*h* on the output transformer 358. Arc current is monitored by a current transformer 378 connected between heater winding 358*g*, which drives one end of the lamp(s) and the end of main output winding 358*c* which is connected to heater winding 358*d*.

As described previously, the power at which the series resonant mode oscillator runs is controlled by the currents in transistors 306, 308. The output voltage when no arc current exists, or the arc current when arcs are struck, is a function of the series resonant mode oscillator power. The higher switch 348 current is allowed to rise, the higher the output voltage or arc current. Hence, by applying the voltage and arc current signals (fifth and sixth signal, respectively) to transistors 306, 308, respectively, via error control amplifiers as negative feedback, the output voltage and arc current are controlled.

The arc current flowing through the primary of current transformer 378 causes a proportional secondary current suitably scaled. This secondary current is passed through bridge rectifier 386 and the parallel network of resistor 392 and capacitor 394. The resultant DC voltage smoothed by capacitor 394 is the mean value of the secondary current from transformer 378. That is, it is a DC analog of the mean arc current. Its polarity is negative for compatibility with error amplifier 388. The currents in resistors 398, 412 represent the desired lamp arc current. These two currents are added to the current flowing in resistor 390 to the output of bridge 386. It is applied to the summing input of 388. The output of amplifier 388 goes higher when the arc current is higher than desired and lower when the arc current is lower than desired. Capacitor 400 in conjunction with the net effect of resistors 390, 398, 412, reduces the feedback loop gain at high frequencies to ensure stability of the arc current control loop.

The output voltage analog, as produced by winding 358*h*, is rectified by diode 382 giving a negative DC voltage on capacitor 384 proportional to the sine wave peak of the output voltage. Resistor 380 limits charging current through diode 382, winding 358*h* being a very low impedance source.

The current in resistor 300 (shown in FIG. 2C) represents the desired output voltage. It is added to the current flowing in resistor 303 to diode 382, and applied to the summing input of amplifier 298. The output of amplifier 298 goes higher when the output voltage is higher than desired and lower when the output voltage is lower than desired. Capacitor 304, in conjunction with the net effect of resistors 300, 302, 303 reduces the feedback loop gain at higher frequencies to ensure stability of the output voltage loop.

The current in transistors 306, 308 must be controlled such that the arc current follows the desired level (set by current in resistors 398, 412) until the maintenance of this level causes the output voltage to reach its currently desired level, as set by current in resistor 300. The ballast must then change to a constant voltage operating mode. These requirements are met by mixing the outputs from amplifiers 298, 388 using transistors 306, 308. The voltage across resistor 310 is set by the emitter voltage of transistor 306 or 308, which ever is the higher. This will be approximately 600 mV below the higher of the two outputs from amplifiers 298, 388. The output from the other amplifier will go low because the arc current is low when the ballast is in its output voltage control mode. The voltage is low when the ballast is in its arc current control mode. It should be noted that whichever of transistors 306, 308 output is lower will be biased off. It follows that the total emitter current, and hence collector current, of transistors 306, 308 is a function of the higher output voltage from amplifiers 298, 388 and the value of resistor 310. As described previously, this current will control the power at which the series resonant mode oscillator runs.

Amplifiers 298, 388 are supplied from a low voltage (7 V) node 147 so that transistors 306, 308 can never be reverse biased more than 7 V. This would exceed the maximum reverse base-emitter voltage. When power is first applied to ballast 10, or when it comes out of EO mode, the output voltage should start from zero. To ensure this, the current through resistor 300 must be negative, or at worst, non-positive at the time the output of comparator 286 goes high, enabling the output stage. By taking the non-inverting input of amplifier 298 to a small positive voltage at the junction between resistors 404, 406 (yet to be explained) and pulling the junction of resistors 300, 302 down near zero by diode 292 to comparator 286, the current in resistor 300 will start negative.

When the output of comparator 286 is low, it discharges capacitor 296 via diode 292 and resistor 294. Resistor 294 has to be included to allow the output of comparator 286 to fall rapidly when the voltage on terminal 44 drops at power down. (It is damaging to switch 348 for it to have intermediate gate voltages for any extended period.)

With capacitor 296 discharged and the current through resistor 300 negative, the output voltage will be very low. When the output of comparator 286 goes high, capacitor 296 charges through resistors 294, 302 toward a steady state when no further current flows into capacitor 296. This charging time constant is set to allow the correct heater sequence described previously. The steady state is a function of the voltage on node 147, as determined by the voltage in resistor 300 less the voltage of the junction of resistors 404, 406 divided by the value of resistors 300+302.

Once the arcs have struck, the ballast is controlled by currents in resistors 398, 412, representing the desired arc current. Resistor 412 provides a small standing current to set the minimum arc current to be flowing when potentiometer 396 is set to zero and/or the external dimming signal is at extreme dim.

The light brightness is closely related to the lamp arc current, such that brightness may be controlled by control of arc current. Assume comparator 402, shown in FIG. 2D, which has an open collector output, to be high. The wiper voltage at the maximum setting of potentiometer 396 then is defined by the values of potentiometer 396 and resistor 410, resistors 398, 408 being very much higher. It follows that arc current can be controlled from minimum to maximum (full scale) by adjusting the wiper of potentiometer 396 from the zero end (joined to terminal 42) to the end joined to resistor 410.

Assume now that potentiometer 396 is set for maximum arc current. If comparator 402 then switches to its output low state, the arc current will fall to its minimum value. If comparator 402 is switched between its high and low states repetitively at a relatively high frequency, such that the time constant around amplifier 388, generated by capacitor 400 and resistors 398, 412, integrates the two minimum and maximum levels, then the arc current will be its maximum value times the ratio of the time that the output of comparator 402 is high to the combined total of time that it is high and low. Comparator 402 operates in this manner when an external dimming signal is present. This dimming signal is the same amplitude modulated signal that controls EO. When the external signal is absent or has a very small amplitude, it has no effect on the ballast operation. As it increases in amplitude, the arc current is reduced. When the external control signal gets to a higher value, the ballast goes into EO mode as described previously. The lamps are thus controllable between 10% and 100% of their maximum brightness. If potentiometer 396 is set, for instance, at half scale, the lamps are controllable between 5% and 50% of their maximum brightness.

The control signal can have any waveform other than a square waveform, but for practical use should have at least a sine wave or ideally, a triangular wave. Secondary winding **106*b* feeds a second clamp circuit including diode 416, capacitor 284, and bleed resistor 414. These clamp components DC reference the negative peak of the AC signal to the terminal 42 (and therefor conductor 36) potential. Comparator 402 then compares the instantaneous voltages throughout the waveform against a small reference voltage existing between resistors 404, 406, which resistors provide a potential divider connected to node 147. So long as the control waveform is not a square wave, the operation of comparator 402** is a PWM system giving the desired control of arc current.

The embodiment described drives rapid start 40 W and similar lamps. Other lamp types can be driven by simple non-inventive changes to this ballast. For instance, instant-start lamps, referred to as Slimline lamps do not use heaters and operate at different currents. High and Super High Output (HO and SHO) lamps run at much higher arc currents, but lower voltages. High Intensity Discharge (HID) lamps do not give the close tracking characteristic between light output and arc current that fluorescent lamps give. It is more practical to drive these HID lamps with constant power ($V_{arc} \times I_{arc}$) rather than constant arc current. This can be achieved using the above ballast technology with the arc current control system replaced by a power control system. This power control system uses a multiplier function. The monitored arc current and voltage from capacitors 384, 394 being multiplied together and converted to a current to replace that from transistors 306, 308. The open circuit voltage control is retained.

Dimming and Electronic Off Control

Remote control circuit 28, also referred to herein as external signal creating means, provides controlled electronic dimming of fluorescent lamps in a manner using less power than prior art opto-coupler and PWM techniques, and avoiding the RFI problems of the prior power line communication art. For maximum utilization of a dimmable ballast, it is desirable to send information from the low voltage environment of a controller or computation system to the high voltage environment of the ballast proper associated with a luminaire. Underwriter Laboratories and other safety standard authorities require that these two environments be electrically isolated to specifically withstand 2.5 times the maximum high voltage in the high voltage environment plus 1,000 V RMS, 60 Hz. This is typically 2.5 KV.

The prior art of opto-coupling requires approximately 20 mA of PWM photo diode current per ballast. It can be costly to provide this in a large system. The prior art of power line communication requires a solution to problems that may exist in any modern commercial building, such as congestion of power line communication data, interference from machinery, and the power line communication interfering with other building activities, such as radio and computer systems.

The present embodiment uses a low frequency amplitude modulated signal, in the range of about 400 to 2,000 Hz, at up to 10 V peak-to-peak amplitude. Such a signal can be transmitted in wiring similar to that used for telephone links.

Referring to FIG. 3, isolation of the control portion of remote control circuit 28 is provided by a small transformer 474, with its primary winding well spaced from the high voltage secondary windings. The core is grounded to the building ground, as by connection with the luminaire metalwork. The signal waveform can be any shape other than a square wave, but for practical purposes it should be at least a sine wave, and ideally, a sawtooth wave. The chosen system is arranged such that, with no signal or less than a 1 V peak-to-peak signal, the ballast proper (as illustrated in FIGS. 2A–2D) will not be affected. In this case, the output is determined by the value set in the ballast control, such as by potentiometer 396.

Increasing signal amplitude above 1 V peak-to-peak causes the lamps to dim until at approximately 7 V peak-to-peak, a critical amplitude, the ballast goes to EO. The circuits within ballast 10 have been described in detail previously. The generation of the signal may be achieved by many techniques. A preferred method, when using photo cells to control lighting via a simple dedicated controller, is shown in FIG. 3. More complex and ambitious systems using various levels of building management computation may generate the same, or similar signals by other techniques, many of which are known by those skilled in the art.

The circuit of FIG. 3 is organized to operate from a single positive 15 V supply 420, such as may be readily generated using a small line transformer and rectifier. This supply does not have to be well regulated. A second reference supply of approximately +5 V is generated at node 424 by zener diode 418 and resistor 422. This power supply circuit is shown in the lower center of the figure.

Oscillator 92 is an astable oscillator comprised of comparator 426, pull-up resistor 440, bias resistors 430, 432, and timing components including resistors 434, 436, capacitor 428, and diode 438. Oscillator 92 generates a waveform at the output of comparator 426 similar to the rectangular waveform shown on the figure which has largely unequal periods of high and low voltages. It is high approximately 95% of the time.

This waveform is then shaped by wave shaper network 94 comprised of resistors 442, 446, capacitor 444, and diodes 448, 450. During the period that comparator 426 is high, the voltage between diodes 448, 450 rises exponentially to approximately +12 V. During the period that comparator 426 is low, the voltage between the diodes falls faster than it rose due to diode 448 opening and shunting resistor 442 with resistor 446. When the voltage has fallen to approximately 600 mV below reference voltage node 424, diode 450 opens, clamping it at this level. Hence, the waveform between the diodes has approximately a sawtooth shape, as shown in the figure, rising from 5 V to 12 V and then dropping rapidly back to 5 V, where it remains for an approximately 5% duty cycle. This voltage is fed through resistor 454 to voltage controlled resistor (VCR) 452, the opposite terminal of which is connected to reference supply node 424. By this connection, the voltage at the junction of resistor 454 and VCR 452 has a negative peak at approximately the node 424 voltage. Its amplitude is modulated by VCR 452 to resistor 454 impedance ratio. It has a smaller amplitude when VCR 452 has a lower resistance. Resistor 458 sets a minimum conductance at the VCR's terminals ensuring that amplifier 460 will never saturate.

The output from amplitude modulator 96 is amplified by amplifier circuit 98, specifically amplifier 460, with the gain being set by resistors 462, 464. The method of connection of amplifier 460 causes its output voltage to be a larger version of the voltage from amplitude modulator 96. Its negative peak is still at the node 424 voltage level, ensuring that the amplifier output is never near saturation (at either supply line). This signal at amplifier 460's output is a low impedance source capable of driving many ballast luminaire systems. The DC component of the waveform is removed by a coupling capacitor 466 which feeds the signal to output terminals 468, 470. The polarity of this control signal is important.

The amplitude of the output is controlled by simulating a typical ballast circuit, using ballast simulator 100. The resultant signal is compared with a brightness demand signal existing on conductor 104 and the error signal thereby produced is fed through an error amplifier as negative feedback to VCR 452. The ballast simulating circuit includes capacitor 480, diode 484, and bleed resistor 486, which DC restore the output waveform such that the voltage at the inverting input of comparator 482 is a replica of the output voltage at output terminal 468, but having its negative peak at zero volts. Comparator 482 is biased in the same fashion as comparator 402 of computation circuit 75 by resistors 494, 496 at its non-inverting input connected between the reference voltage at node 424 and zero volts provided by ground. Hysteresis is introduced by resistor 498. Resistor 488 pulls comparator 482's output up to the reference voltage on node 424 whenever its open collector output is high.

As in the ballast output circuit, comparator 482 outputs a PWM signal having a high value equal to the voltage on node 424 and a low value equal to zero volts. This PWM signal is converted to a DC level at the junction between resistor 490 and capacitor 492, which components determine the associated time constant. This DC level is an analog of the voltages present in the ballast output circuit which defines the arc current. The light output from the lamps closely tracks arc current.

The voltage at the junction between resistor 490 and capacitor 492 is connected to scaling resistor 502 at the input of error amplifier circuit 102, and in particular, at the inverting input of amplifier 500. Resistor 512 sets the error amplifier gain at DC. Capacitor 514 reduces the higher frequency gain to ensure the stability of the feedback system. Resistor 516 couples the output voltage from amplifier 500 to the control gate of VCR 452. Resistor 516 is provided to prevent excessive positive gate current in VCR 452.

A light output demand signal is input on conductor 104. It is connected to the non-inverting input of amplifier 500 by resistor 508. Capacitor 510 removes high frequency noise signals generated in external wiring connected to conductor 104.

There are a variety of ways that could be used to generate a signal on conductor 104 to control the light output, ranging from a simple manually controlled potentiometer to sophisticated shaped response feedback systems. The scheme shown in FIG. 3 uses a photo diode 504 fed from current source 506. The diode is more conductive, and therefore develops less voltage on conductor 104 when the light level is higher, giving negative feedback to control the light to a level defined by current source 506.

This completes a description of the operation of the preferred embodiment as shown in FIGS. 2A–2D and FIG. 3.

It can be seen that the invention provided by the preferred embodiment achieves AC/DC power conversion while maintaining good input power factor, low line current distortion, good line and load regulation, low RFI, immunity to line surges and transients, and extremely high efficiency. The circuit provided makes all the necessary back-up computations to provide a practical power supply. The inductor of the power supply cannot saturate, nor can the design maximum switch current be exceeded. While the invention has been particularly shown and described with reference to the foregoing preferred embodiment, it will be understood by those skilled in the art that other changes in form and detail may made therein without departing from the spirit and scope of the invention as defined in the following claims.

It is claimed and desired to secure by Letters Patent:

1. A power supply for producing a direct-current output voltage from a unidirectional-current input voltage comprising:

a pair of unidirectional-current input terminals for receiving the unidirectional-current input voltage;

inductor means joined to said input terminals;

first switch-means in series connection between one of said terminals and said inductor means and, responsive to a switching signal for operating selectively in a closed state to connect said terminal to, an in an open state to disconnect said terminal from, said inductor means;

a pair of direct current output terminals;

energy storage means coupled to said inductor means and joined between said output terminals for receiving and storing energy transmitted from said inductor means and for applying direct-output voltage to said direct-current output terminals; and first circuit means joined to said first switch-means and including inductor current sensing means for producing a first signal representative of the current in said inductor means, and reference voltage generating means for generating a second signal indicative of a desired maximum inductor means current;

said first circuit means being responsive to the first and second signals for producing the switching signal for opening said first switch-means when the current in said inductor means reaches the desired maximum inductor means current and closing said first switch-means when the current in said inductor means reduces to zero.

2. The power supply of claim 1 wherein said generating means is responsive to the unidirectional current input and the second signal is representative of the unidirectional-current input voltage.

3. The power supply of claim 2 further including means for limiting the second signal to a predetermined maximum level which is independent of the level of the unidirectional-current input voltage.

4. The power supply of claim 2 wherein said generating means includes means for generating a third signal indicative of a desired direct-current output voltage and a fourth signal indicative of the actual direct-current output voltage, and further includes adjustment means responsive to the third and fourth signals for changing the value of the second signal inversely as the actual direct-current output voltage changes with respect to the desired direct-current output voltage.

5. The power supply of claim 5 wherein said adjustment means includes error signal producing means for producing an error signal derived from the difference between the third and fourth signals and modulation means for modulating said error signal with the unidirectional-current input voltage, with the second signal being indicative of this modulated error signal.

6. The power supply of claim 5 wherein the modulating provided by said modulation means includes multiplying the error signal by the unidirectional-current input voltage.

7. The power supply of claim 6 wherein said error signal producing means includes integrator means for producing an error signal indicative of an integral of the difference between the third and fourth signals.

8. The power supply of claim 1 wherein said generating means further includes means for generating a third signal indicative of a desired direct-current output voltage and quick response means responsive to the actual direct-current output voltage and the third signal for reducing the second signal to a predetermined minimum level when the actual direct-current output voltage reaches a predetermined value which is greater than the desired direct-current output voltage.

9. The power supply of claim 1 which further includes switch enabling means coupled to said first circuit means and responsive to a reference signal indicative of a desired unidirectional-current input voltage level and also responsive to a signal indicative of the unidirectional-current input voltage level, for modifying the switching signal such that said first switch-means cannot be closed when the unidirectional-current input voltage level is less than the desired unidirectional-current voltage level.

10. The power supply of claim 9 further including means for electrically isolatingly transferring the switching signal from said first circuit means to said first switch-means.

11. The power supply of claim 10 wherein said transfer means is operable only after a predetermined direct-current output voltage is reached, said power supply further comprising bootstrap circuit means, said bootstrap circuit means including means defining a reference switch-means current greater than a predetermined normal operating current and means defining a delay time interval, said bootstrap circuit means being operable, when the direct-current output voltage is below the previously-mentioned predetermined direct-current output voltage, for sensing the current in said first switch-means, for generating a switching signal appropriate for closing said first switch-means until the predetermined reference switch-means current is reached, and for then generating a switching signal appropriate for opening said first switch-means for a time interval equal to the previously-mentioned delay time interval, this switch closing and opening being performed repetitively so long as the reference switch-means current is reached during the time period said first switch-means is in a closed state.

12. The power supply of claim 9, which further includes external signal-creating means for producing an electronic off-signal defining whether it is desired to operate said power supply while it is joined to the unidirectional-current input, and wherein said switch enabling means is further responsive to the electronic off signal for modifying the switching signal such that said first switch-means cannot be closed when the electronic off signal defines that it is desired not to operate said power supply.

13. The power supply of claim 12 wherein said external signal-creating means comprise:

means for generating an amplitude modulated signal, having a critical amplitude, at a frequency which is in an audio range; and means associated with said power supply for detecting said amplitude modulated signal and for disabling the operation of the first switch-means when said critical amplitude is detected.

14. The power supply of claim 12 wherein said external signal-creating means is electrically isolated from said power supply.

15. The power supply of claim 1 wherein alternating current power is supplied to a load at a predetermined maximum operating voltage level and a designated operating current level, further including resonant circuit means coupled to the load for storing electromagnetic energy;

selective electrical coupling means for selectively electrically coupling the output terminals to the resonant circuit means;

means coupled to the resonant circuit means for generating an internal current signal representative of the current flow through the selective electrical coupling means;

means for sensing the level of voltage being supplied to the load and for generating a voltage error signal representative of the difference between said level of voltage being supplied to the load and the predetermined maximum operating voltage level;

means for sensing the level of current being supplied to the load and for generating a current error signal representative of the difference between said level of current being supplied to the load and the designated operating current level;

means for converting the internal current signal, the voltage error signal, and the current error signal into corresponding proportional direct current bias signals; and integrating means coupled to the converting means for providing an integral of the direct current bias signals, and for controlling the selective coupling means to decouple the resonant circuit means from the output terminals when the integral of the direct current bias signals exceeds a predetermined magnitude, so that changes in the direct current bias signals corresponding to changes in the current error signal or the voltage error signal alter the duration for which the resonant circuit means are coupled to the output terminals.

16. The power supply of claim 15 which further includes means for sensing the voltage level in the selective electrical coupling means and for resetting the integrating means whenever the voltage across the selective electrical coupling means falls to about zero.

17. The power supply of claim 15 which further includes auxiliary output terminals for providing the alternating current power, wherein the auxiliary output terminals include series connected power limiting means for limiting the power being supplied through the auxiliary output terminals.

18. The power supply of claim 17 wherein said power limiting means limits power as a function of the frequency of the alternating current power.

19. The power supply of claim 18 wherein the frequency dependence of said power limiting means is selected so that the level of current which can be supplied by the auxiliary terminals increases as the operating power level of the resonant circuit means decreases.

20. The power supply of claim 19 wherein said power limiting means comprise means for capacitively coupling the alternating current power to the auxiliary terminals.

21. The power supply of claim 18 wherein the frequency dependence of said power limiting means is selected so that the level of current which can be supplied by the auxiliary terminals increases as the operating power level of the resonant circuit means increases.

22. The power supply of claim 21 wherein the power limiting means comprise means for providing an inductance in series with the auxiliary output terminals.

23. The power supply of claim 16 wherein the resonant circuit means comprise a series resonant power oscillator which includes a series connected inductor and capacitor, and further wherein the selective electrical coupling means comprise switch-means for selectively coupling the output terminals across the inductor, wherein said switch-means has a finite resistance so that a voltage is generated across said switch-means which is representative of the level of current flowing through the inductor, when the switch-means are operated to couple the output terminals across the inductor, and which is representative of the level of voltage in the selective electrical coupling means, when the switch-means are operated to decouple the output terminals from across the inductor, and so that the switch-means also function as the internal current signal generating means.

24. The power supply of claim 23 which further includes clamp means electromagnetically coupled to the inductor for drawing energy from the inductor when the voltage across the inductor exceeds a predetermined level.

25. The power supply of claim 24 wherein the inductor is formed as a first winding of a transformer and said clamp means include a second winding formed on the transformer so as to be tightly coupled to the first winding; and means connected in series with the second winding for providing a conductive path when the voltage across the second winding exceeds a predetermined level, where the series combination of the second winding and the conductive path means are connected across the output terminals so that energy is coupled back into the output terminals when the voltage across the second winding exceeds the predetermined level.

26. The power supply of claim 1 which further includes an alternating current source for powering a load operably connected to said direct current output terminals, said alternating current source comprising:

switched resonant oscillator means for producing an alternating current;

second switch driver means for controlling said resonant oscillator means;

output voltage monitor means for producing a fifth signal representative of the output voltage;

arc current monitor means for producing a sixth signal representative of the arc current;

computation circuit means for comparing said fifth and sixth signals and for generating a second switch driver control signal in response to the comparing; and a pair of alternating current output terminals for connecting the alternating current source to the load.

27. The power supply of claim 26 which further includes remote control means having means for generating an amplitude modulated signal of variable, remotely determined amplitude, and wherein said computation circuit means is operable with said amplitude modulated signal to adjust the current reaching the load.

28. The power supply of claim 1 which further includes an alternating current source having a switched resonant oscillator including an oscillator switch, a primary core having a primary and a second winding formed thereon, and diode means; said second winding and said diode means being operable to clamp a voltage transmitted to said second oscillator switch.

29. The power supply of claim 1, which further includes thermally-activated safety switch-means comprising a thermal switch connected in series with one of said input terminals and at least one metal oxide varistor mounted in thermal contact with said thermal switch for temporarily disconnecting the unidirectional-current input terminals from a line power supply when high voltage surges appear on said input terminals.

30. A power supply using current amplitude modulation to produce a direct-current output from a line input signal comprising:

a pair of input line terminals for receiving the line input;

rectifier means joined to said input line terminals for rectifying said line input;

inductor means joined to said input line terminals;

first switch-means in series connection between said rectifier means and said inductor means;

a pair of direct-current output terminals;

energy storage means coupled to said inductor means and joined between said output terminals for receiving and storing energy transmitted from said inductor means and for applying a direct-current output to said direct-current output terminals;

first circuit means joined to said first switch-means and including inductor current sensing means for generating a first signal representative of the current in said inductor means and reference voltage generating means, responsive to the rectified line input, for generating a second signal indicative of a desired maximum inductor means current, said generator means including error signal producing means for producing an error signal indicative of an integral of the difference between the actual direct-current output voltage and a predetermined desired direct-current output voltage and including multiplication means for multiplying an inverse of the error signal by the unidirectional-current input voltage.

31. An apparatus for converting a unidirectional input voltage, which is received at an input terminal, into a direct current output voltage, which is provided to an output terminal, comprising:

energy storage means coupled to the output terminal for storing electromagnetic energy, including inductor means for inductively storing electromagnetic energy;

monitoring means coupled to the energy storage means for monitoring the level of current flowing through the inductor means; and means for selectively coupling the inductor means to and decoupling the inductor means from the input terminal as a functional of the level of current flowing through the inductor means, said selective coupling means including:

means for defining a maximum current level signal and a minimum current level signal, including reference means responsive to the unidirectional input voltage for providing the maximum current level signal proportional to the unidirectional input voltage; and coupling/decoupling means for coupling the inductor means to the input terminals when the level of current flowing through the inductor means falls to about the magnitude of said minimum current level signal, and for decoupling the inductor means from the input terminals when the level of current flowing through the inductor means rises to about the magnitude of said maximum current level signal.

32. The apparatus as recited in claim 31 wherein the direct current output voltage has a preferred level; and which further includes means responsive to the direct current output voltage for generating an error signal which is indicative of the difference between the actual level of the direct current output and the preferred level thereof; and further wherein the reference means include means for varying the proportionality of the maximum current level signal to the unidirectional input voltage as a function of the error signal.

33. The apparatus as recited in claim 32 wherein said varying means comprise means for modulating the amplitude of the maximum current level signal as a function of the magnitude of the error signal.

34. The apparatus as recited in claim 37 wherein the error signal generating means comprise:

means for computing the difference between the actual level and the preferred level of the direct current output voltage; and means for integrating the computed difference, wherein the integral of the computed difference is defined as the error signal.

35. The apparatus as recited in claim 33 wherein the coupling/decoupling means comprise:

switch-means operable between an opened and a closed state for electrically connecting the input terminal to the inductor means, when in the closed state, and for electrically disconnecting the input terminals from the inductor means, when in the open state;

means coupled to the switch-means and responsive to the maximum and the minimum current level signals for comparing the level of the current flowing through the inductor with a first level proportional to the maximum current level signal, while said switch-means are in the closed state, and for comparing the level of the current flowing through the inductor means with a second level proportional to the minimum current level signal, while said switch-means are in an open state, wherein the comparing means operate the switch-means into the opened condition when the level of current flowing into the inductor means rises to about the first level, and operate the switch-means into the closed condition when the level of current flowing into the inductor means falls to about the second level.

36. The apparatus of claim 35 wherein the monitoring means comprise:

means coupled in series with the inductor means for generating a voltage which is proportional to the level of current flowing through the inductor means; and wherein the comparing means further include means for providing a composite signal representative of the magnitude of the combination of the first level interposed in series with but in opposition to the voltage from the monitoring means; and means responsive to the composite signal and to the minimum current level signal for operating the switch-means into the opened state and for suppressing the first level when the composite signal falls to about zero in magnitude, and for unsuppressing the first level and for operating the switch-means into the closed state when the composite signal rises to about zero in magnitude.

37. A direct current voltage switched mode power supply comprising:

line current input terminals;

output terminals for transferring power received on said input terminals to a load;

switch-means coupled to said input terminals and operable for controlling power delivered from said input terminals to said output terminals;

output terminals for transferring power received on said input terminals to a load;

inductor means coupled to said input terminals for storing energy received from said input terminals;

output energy storage means coupled to said inductor means and to said output terminals for receiving energy from said inductor means;

first output voltage error correcting feedback means coupled to said output terminals and having a first predetermined bandwidth responsive to the actual output voltage and a first desired output voltage for appropriately controlling operation of said switch-means;

second output voltage error correcting feedback means coupled to said output terminals, having a second predetermined bandwidth which is higher than the first predetermined bandwidth of said first feedback means, and responsive to the actual output voltage and a second desired output voltage greater than the first desired output voltage for controlling operation of said switch-means when the actual output voltage is higher than a predetermined level, with the first feedback means controlling operation of said switch-means only when the actual output voltage level is less than the predetermined level.

* * * * *